US011073317B2

(12) United States Patent
Kim

(10) Patent No.: US 11,073,317 B2
(45) Date of Patent: Jul. 27, 2021

(54) REFRIGERATOR

(71) Applicant: LG Electronics Inc., Seoul (KR)

(72) Inventor: Hosan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/815,701

(22) Filed: Mar. 11, 2020

(65) Prior Publication Data

US 2020/0208891 A1 Jul. 2, 2020

Related U.S. Application Data

(62) Division of application No. 15/172,361, filed on Jun. 3, 2016, now Pat. No. 10,627,143.

(30) Foreign Application Priority Data

Jul. 28, 2015 (KR) ..... 10-2015-0106878

(51) Int. Cl.
*F25B 47/02* (2006.01)
*F25B 41/04* (2006.01)
(Continued)

(52) U.S. Cl.
CPC ..... *F25B 47/022* (2013.01); *F25B 5/04* (2013.01); *F25B 6/02* (2013.01); *F25B 7/00* (2013.01); *F25B 41/20* (2021.01); *F25D 11/022* (2013.01); *F28D 1/0417* (2013.01); *F28D 1/0477* (2013.01); *F28F 1/325* (2013.01); *F25B 2400/0403* (2013.01);
(Continued)

(58) Field of Classification Search
CPC ..... F25B 5/04; F25B 6/02; F25B 7/00; F25B 41/04; F25B 47/022; F25B 2600/2511; F25B 2600/2507; F25B 2600/2501; F25B 2400/061; F25B 2400/0411; F25B 2400/0409; F25B 2400/0403; F25D 11/022; F28D 1/0417; F28D 1/0477; F28F 1/325
See application file for complete search history.

(56) References Cited

U.S. PATENT DOCUMENTS 5,896,753 A * 4/1999 Kwak ..... F25D 17/065 62/441
6,327,867 B1 * 12/2001 Hyodo ..... F25D 17/065 62/187
(Continued)

FOREIGN PATENT DOCUMENTS

EP 1394481 A2 * 3/2004 ..... F25B 5/04
EP 2420760 A1 * 2/2012 ..... F25D 11/022
JP 2002195723 A * 7/2002

*Primary Examiner* — Frantz F Jules
*Assistant Examiner* — Martha Tadesse
(74) *Attorney, Agent, or Firm* — Fish & Richardson P.C.

(57) ABSTRACT

A refrigerator includes a first refrigeration cycle unit that is configured to circulate a first refrigerant and that includes a first compressor, a first condenser, a first expansion device, and a first evaporator, a second refrigeration cycle unit that is configured to circulate a second refrigerant and that includes a second compressor, a second condenser, a second expansion device, and a second evaporator, a first valve unit installed at an outlet side of the first compressor, and a first hot gas path configured to extend from the first valve unit to the second evaporator and configured to supply the first refrigerant to the second evaporator.

13 Claims, 21 Drawing Sheets

(51) Int. Cl.

| | |
|---|---|
| ***F28D 1/04*** | (2006.01) |
| ***F28F 1/32*** | (2006.01) |
| ***F25D 11/02*** | (2006.01) |
| ***F28D 1/047*** | (2006.01) |
| ***F25B 6/02*** | (2006.01) |
| ***F25B 5/04*** | (2006.01) |
| ***F25B 7/00*** | (2006.01) |
| ***F25B 41/20*** | (2021.01) |

(52) U.S. Cl.
CPC ..... *F25B 2400/0409* (2013.01); *F25B 2400/0411* (2013.01); *F25B 2400/061* (2013.01); *F25B 2600/2501* (2013.01); *F25B 2600/2507* (2013.01)

(56) References Cited

U.S. PATENT DOCUMENTS 8,769,975 B2 * 7/2014 Lee ..... F25B 5/00 62/199
9,494,360 B2 * 11/2016 Tsunoda ..... B60H 1/00921
2002/0069654 A1 * 6/2002 Doi ..... F25B 1/10 62/199
2004/0050083 A1 * 3/2004 Yuasa ..... F25D 11/022 62/222
2007/0199335 A1 * 8/2007 Innes ..... F25B 47/022 62/151
2008/0178621 A1 * 7/2008 Kang ..... F25D 29/00 62/179
2010/0037650 A1 * 2/2010 Lee ..... F25B 5/00 62/498
2012/0047924 A1 * 3/2012 Li ..... F25B 5/02 62/113
2012/0324918 A1 * 12/2012 Bortoletto ..... F25B 5/00 62/73
2014/0245758 A1 * 9/2014 Gu ..... F25D 11/00 62/56
2015/0168024 A1 * 6/2015 Lee ..... F25D 21/006 62/117
2017/0241693 A1 * 8/2017 Tajika ..... F25B 47/022

* cited by examiner

REFRIGERATOR

CROSS-REFERENCE TO RELATED APPLICATION(S)

This application is a divisional of U.S. application Ser. No. 15/172,361, filed on Jun. 3, 2016, which claims priority under 35 U.S.C. § 119 and 35 U.S.C. § 365 to Korean Patent Application No. 10-2015-0106878, filed in Korea on Jul. 28, 2015. The disclosures of the prior applications are incorporated by reference in their entirety.

BACKGROUND

Generally, a refrigerator has a plurality of storage compartments which accommodate stored goods and keep food refrigerated or frozen, and one surface of each of the storage compartments is formed to be opened to allow for a user to access the storage compartment. The plurality of storage compartments may include a freezer compartment in which the food is kept frozen, and a refrigerator compartment in which the food is kept refrigerated.

SUMMARY

According to one aspect, a refrigerator may include a first refrigeration cycle unit that is configured to circulate a first refrigerant and that includes a first compressor, a first condenser, a first expansion device, and a first evaporator, a second refrigeration cycle unit that is configured to circulate a second refrigerant and that includes a second compressor, a second condenser, a second expansion device, and a second evaporator, a first valve unit installed at an outlet side of the first compressor, and a first hot gas path configured to extend from the first valve unit to the second evaporator and configured to supply the first refrigerant to the second evaporator.

Implementations according to this aspect may include one or more of the following features. For example, the second evaporator may include a first pipe configured to guide flow of the first refrigerant, a second pipe that is configured to guide flow of the second refrigerant and that is configured to connect to the first hot gas path, and a fin coupled to the first pipe and the second pipe. The first valve unit may include a three-way valve with one inlet part and two outlet parts. The first evaporator may be a refrigerator compartment evaporator and the second evaporator may be a freezer compartment evaporator. The refrigerator may include a third evaporator which is provided in the second refrigeration cycle unit. The refrigerator may include a second hot gas path configured to supply the second refrigerant to the third evaporator. The refrigerator may include a second valve unit disposed at an outlet side of the second condenser, and a third valve unit disposed at an outlet side of the second valve unit and connected to an inlet side pipe of the third evaporator.

The second hot gas path may be connected to the second valve unit and is configured to extend to the third evaporator. The refrigerator may include a bypass path that is configured to allow the first refrigerant to bypass the third evaporator, and that is configured to extend to an outlet side of the third evaporator from the third valve unit. The second valve unit may include a four-way valve, and the third valve unit may include a three-way valve. A first evaporation fan provided on one side of the first evaporator may be configured to defrost the first evaporator. The refrigerator may include a second valve unit disposed at an outlet side of the second condenser, and that is configured to connect to the second hot gas path. The refrigerator may include a bypass path that is configured to extend to an outlet side of the third evaporator from the second valve unit, where the second hot gas path is configured to extend to the bypass path from the third evaporator. The first hot gas path may be configured to extend to the third evaporator from the first valve unit, and may be configured to extend to the second evaporator from the third evaporator. The first hot gas path may be configured to extend to an outlet side pipe of the first condenser from the second evaporator.

According to another aspect, a refrigerator may include a first refrigeration cycle unit that is configured to circulate a first refrigerant and that includes a first compressor, a first condenser, a first expansion device, and a first evaporator, a second refrigeration cycle unit that is configured to circulate a second refrigerant and that includes a second compressor, a second condenser, a second expansion device, and a second evaporator, a first valve unit installed at an outlet side of the first compressor, and a first hot gas path configured to extend to the second evaporator from the first valve unit, where the second evaporator includes a first pipe configured to guide flow of the first refrigerant, and a second pipe that is configured to guide flow of the second refrigerant and that is configured to connect to the first hot gas path.

Implementations according to this aspect may include one or more of the following features. For example, the first valve unit may be configured to allow the first refrigerant to flow to the second evaporator, and defrost the second evaporator, wherein the first refrigerant is configured to pass through the second evaporator to the first evaporator. The refrigerator may include a third evaporator provided in the second refrigeration cycle unit, a second hot gas path configured to supply the second refrigerant to the third evaporator, and a second valve unit disposed at an outlet side of the second condenser. The second valve unit may be configured to allow the second refrigerant that passed through the second condenser to be supplied to the third evaporator through the second hot gas path, and the second refrigerant that passed through the third evaporator is evaporated at the second evaporator. The first valve unit may be configured to allow the first refrigerant to flow to the third evaporator and the second evaporator, and defrost the third and second evaporators in order, and the first refrigerant passes through the second evaporator and then flow to the first evaporator.

DETAILED DESCRIPTION

Figure 1:
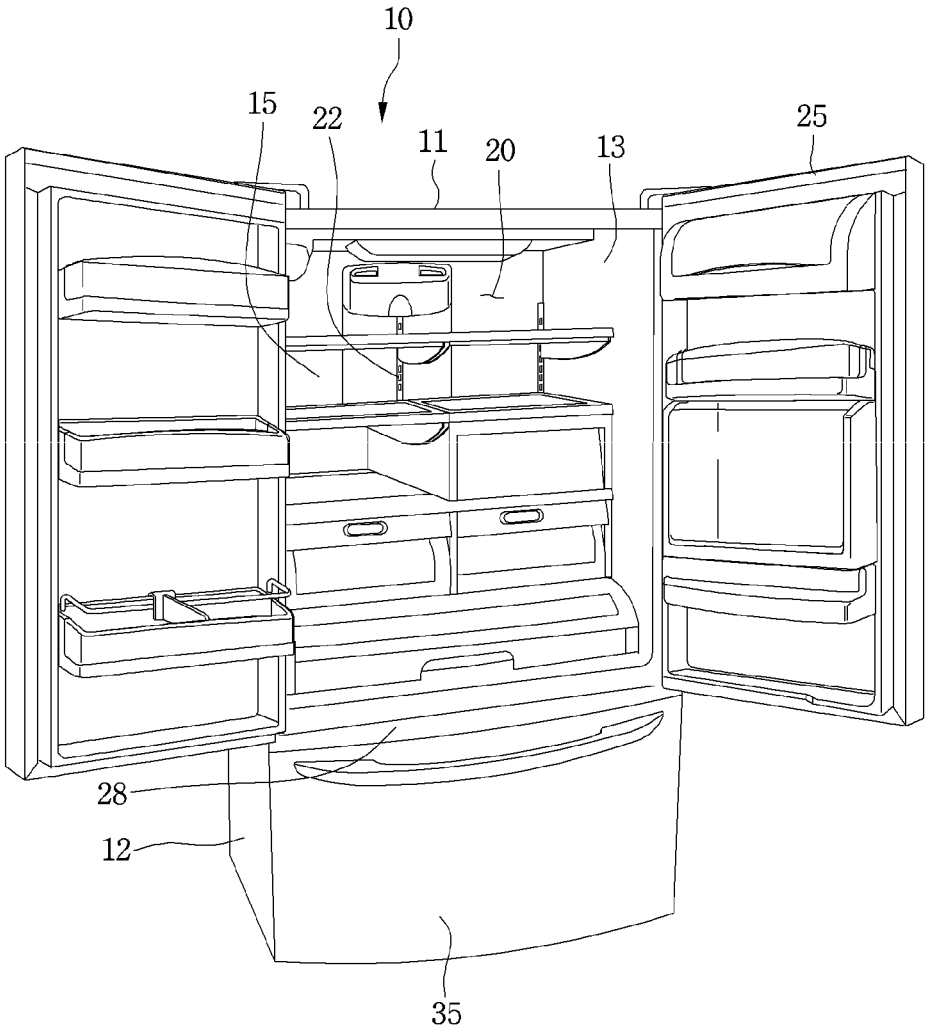
FIG. 1 is a perspective view illustrating an example of a refrigerator.

Referring to FIGS. 1 to 4, a refrigerator 10 may include a cabinet 11 which forms a storage compartment. The storage compartment may include a refrigerator compartment 20 and a freezer compartment 30. For example, the refrigerator compartment 20 may be disposed at an upper side of the freezer compartment 30. However, positions of the refrigerator compartment 20 and the freezer compartment 30 are not limited to these configurations. The refrigerator compartment 20 and the freezer compartment 30 may be divided by a partition wall 28.

The refrigerator 10 may include a refrigerator compartment door 25 which is configured to open and close the refrigerator compartment 20, and a freezer compartment door 35 which is configured to open and close the freezer compartment 30. The refrigerator compartment door 25 may be hinge-coupled to a front of the cabinet 11 and may be formed to be rotatable, and the freezer compartment door 35 may be formed in a drawer type to be withdrawn forward.

Based on the cabinet 11 of FIG. 1, a direction at which the refrigerator compartment door 25 is located is defined as a "front side", and an opposite direction thereof is defined as a "rear side", and a direction toward a side surface of the cabinet 11 is defined as a "lateral side".

The cabinet 11 may include an outer case 12 which forms an exterior of the refrigerator 10, and an inner case 13 which is disposed inside the outer case 12 and forms at least a part of an inner surface of the refrigerator compartment 20 or the freezer compartment 30. The inner case 13 includes a refrigerator compartment side inner case which forms the inner surface of the refrigerator compartment 20, and a freezer compartment side inner case which forms the inner surface of the freezer compartment 30.

A panel 15 is provided at a rear surface of the refrigerator compartment 20. The panel 15 may be installed at a position which is spaced forward from a rear of the refrigerator compartment side inner case. A refrigerator compartment cooling air discharge part 22 for discharging cooling air to the refrigerator compartment 20 is provided at the panel 15. For example, the refrigerator compartment cooling air discharge part 22 may be formed of a duct, and may be disposed to be coupled to an approximately central portion of the panel 15.

A freezer compartment side panel may be installed at a rear wall of the freezer compartment 30, and a freezer compartment cooling air discharge part for discharging the cooling air to the freezer compartment 30 may be formed at the freezer compartment side panel.

An installation space in which a first evaporator 130 is installed is formed at a space between the panel 15 and a rear of the inner case 13. An installation space in which a second evaporator 150 is installed may be formed at a space between the panel and a rear of the freezer compartment side inner case.

The refrigerator 10 may include a plurality of evaporators 130 and 150 which cool the refrigerator compartment 20 and the freezer compartment 30, respectively. The plurality of evaporators 130 and 150 include the first evaporator 130 which is configured to cool the refrigerator compartment 20, and the second evaporator 150 which is configured to cool the freezer compartment 30. The first evaporator 130 may be referred to as a "refrigerator compartment evaporator", and the second evaporator 150 may be referred to as a "freezer compartment evaporator".

Figure 2:
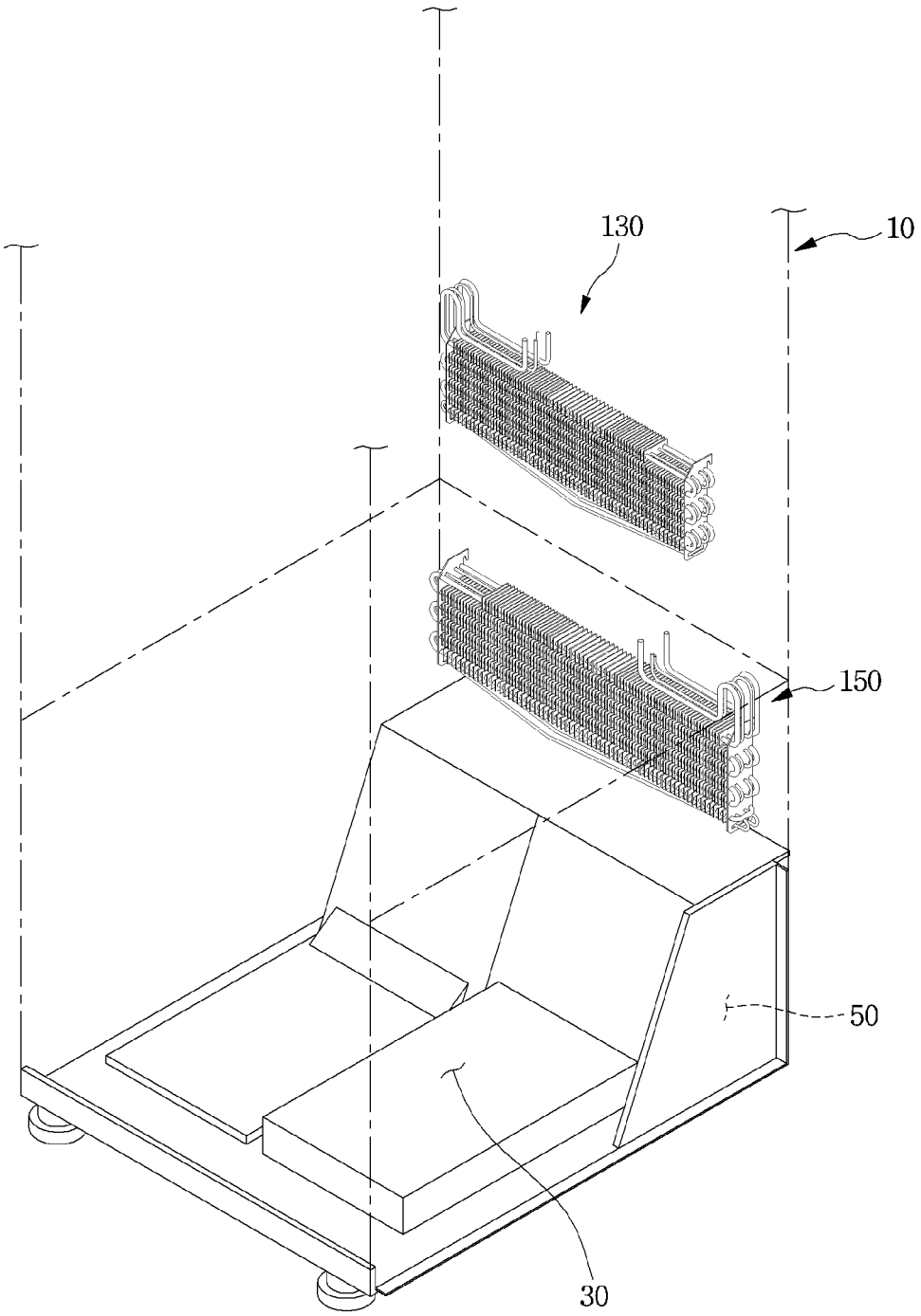
FIG. 2 is a view illustrating the refrigerator.
Figure 3:
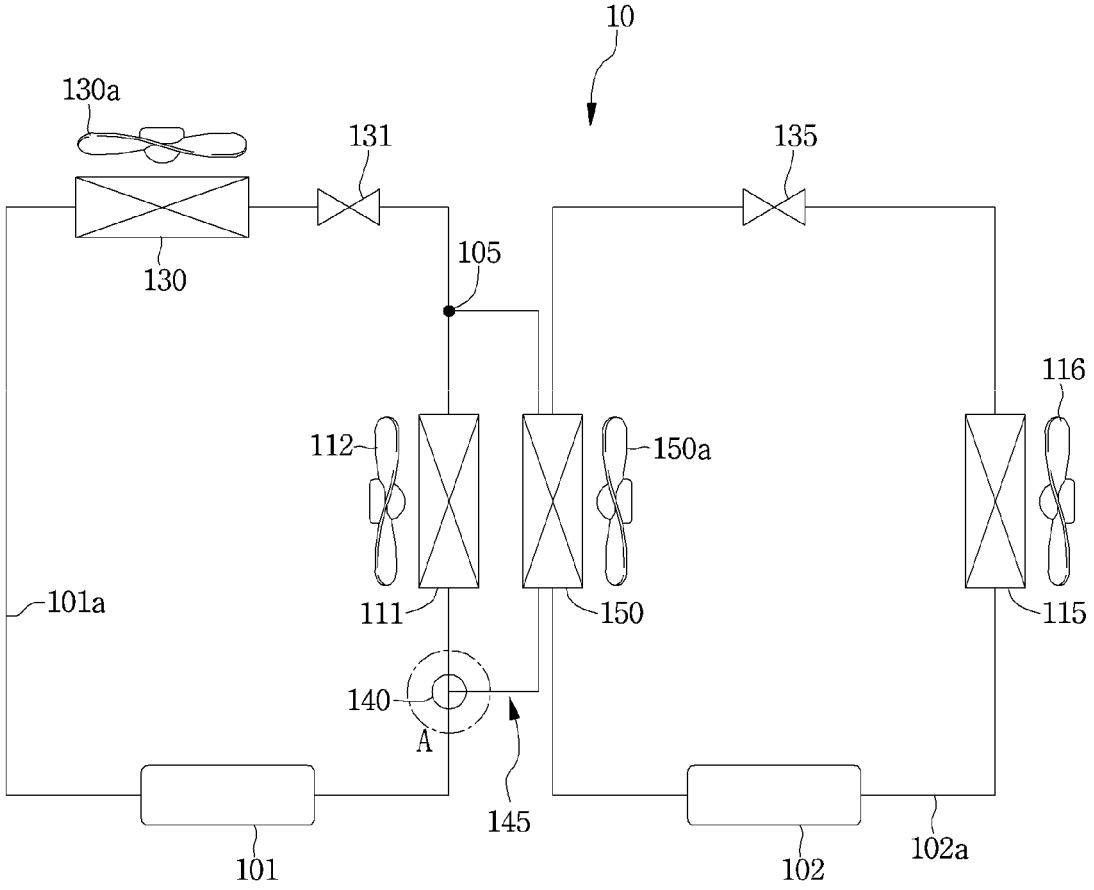
FIG. 3 illustrates an example of a cycle of the refrigerator.
Figure 4:
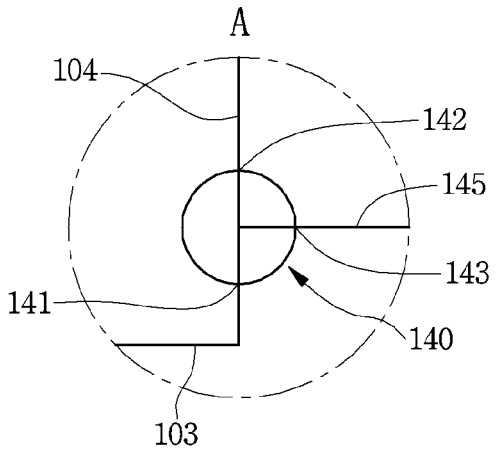
FIG. 4 is an enlarged view of an A portion of the FIG. 3.

The refrigerator compartment 20 is disposed at an upper side of the freezer compartment 30, and as illustrated in FIG. 2, the first evaporator 130 may be disposed at an upper side of the second evaporator 150.

The first evaporator 130 may be disposed at a rear wall of the refrigerator compartment 20, i.e., a rear side of the panel 15, and the second evaporator 150 may be disposed at a rear wall of the freezer compartment 30, i.e., a rear side of the freezer compartment side panel. The cooling air generated at the first evaporator 130 may be supplied to the refrigerator compartment 20 through the refrigerator compartment cooling air discharge part 22, and the cooling air generated at the second evaporator 150 may be supplied to the freezer compartment 30 through the freezer compartment cooling air discharge part.

Figure 7:
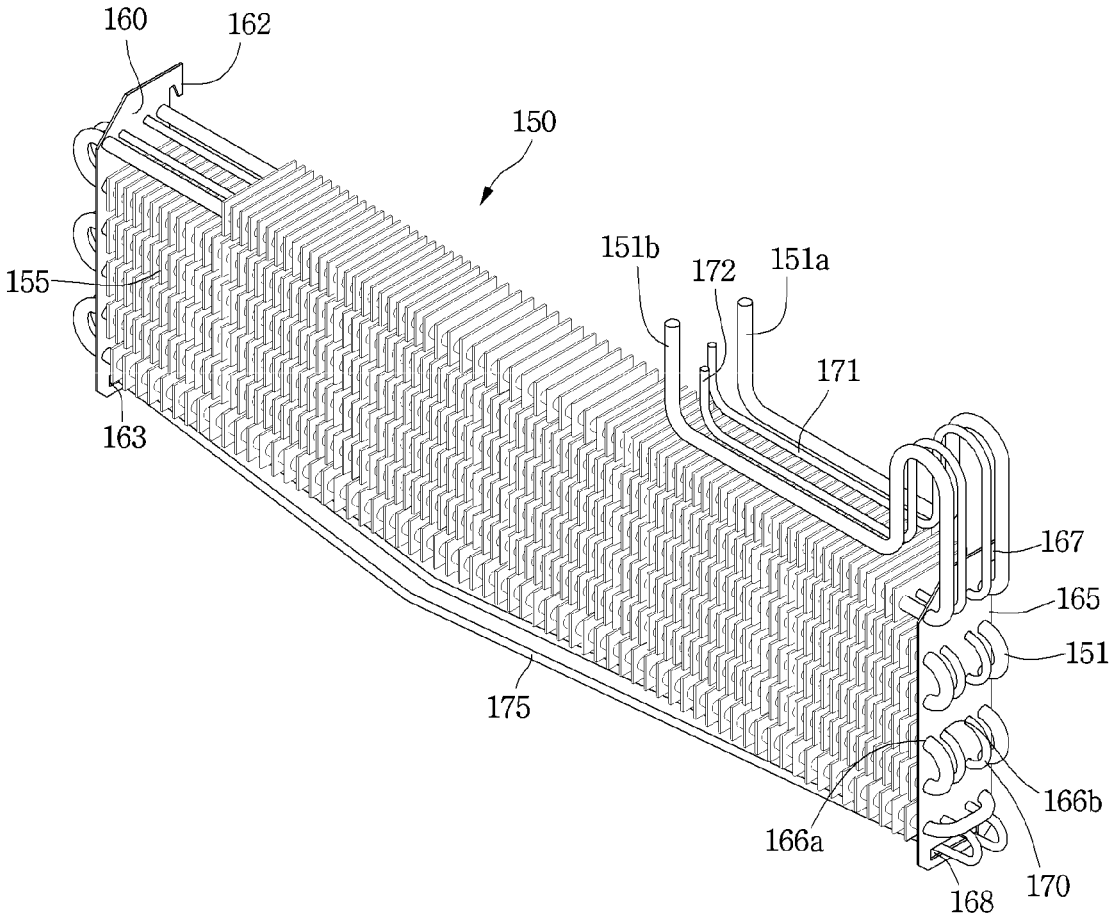
FIG. 7 is a view illustrating an example of a second evaporator of the refrigerator.
Figure 8:
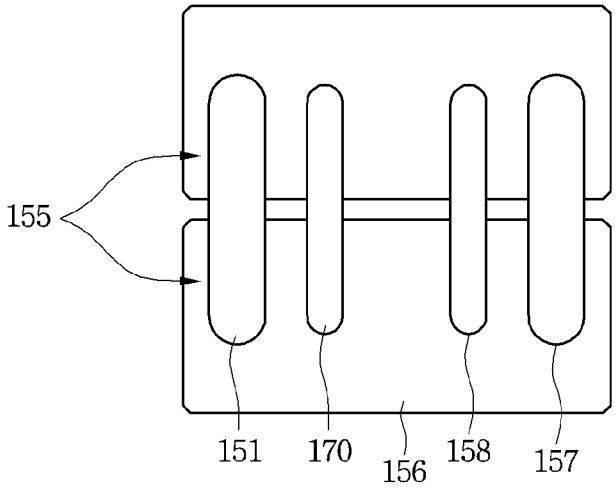
FIG. 8 is a view illustrating an example of a first and a second pipes coupled to a pin.

The first evaporator 130 and the second evaporator 150 may be hooked to the inner case 13. For example, the second evaporator 150 includes hooks 162 and 167 (referring to FIG. 7) which are hooked to the inner case 13.

The refrigerator 10 may include a plurality of devices for driving a refrigeration cycle. The refrigeration cycle includes a first refrigeration cycle (hereinafter, referred to as first cycle) and a second refrigeration cycle (hereinafter, referred to as second cycle). The first cycle is understood as a cycle which has an evaporation pressure relatively high for cooling a refrigerator compartment. On the other hand, the second cycle is understood as a cycle which has an evaporation pressure relatively low for cooling a freezer compartment.

Specifically, the first cycle of the refrigerator 10 includes a first compressor 101 which compresses a refrigerant, a first condenser 111 which condenses the refrigerant compressed in the first compressor 101, a first expansion device 131 which depressurizes the refrigerant condensed in the first condenser 111, and a first evaporator 130 which evaporates the refrigerant depressurized in the first expansion device 131. The refrigerant which circulates in the first cycle may be referred to as "a first refrigerant". The first evaporator 130 includes a refrigerator compartment evaporator which cools the refrigerator compartment 20, and the first expansion device 131 may include a capillary tube.

The first cycle of the refrigerator 10 further includes a fan which is provided at one side of a heat exchanger to blow air. The fan includes a first condenser fan 112 which is provided at one side of the first condenser 111, and a first evaporator fan **130*a* which is provided at one side of the first evaporator 130**

The first cycle of the refrigerator 10 further includes a first refrigerant pipe **101*a*** which connects the first compressor 101, the first condenser 111, the first expansion device 131, and the first evaporator 130 and guides a flow of the refrigerant.

The second cycle of the refrigerator 10 includes a second compressor 102 which compresses a refrigerant, a second condenser 115 which condenses the refrigerant compressed in the second compressor 102, a second expansion device 135 which depressurizes the refrigerant condensed in the second condenser 115, and a second evaporator 150 which evaporates the refrigerant depressurized in the second expansion device 135. The refrigerant which circulates in the second cycle may be referred to as "a second refrigerant", the second refrigerant is not mixed with the first refrigerant. The second evaporator 150 includes a freezer compartment evaporator which cools the freezer compartment 30. The second expansion device 135 may include a capillary tube.

The second cycle of the refrigerator 10 further includes a fan which is provided at one side of a heat exchanger to blow air. The fan includes a second condenser fan 116 which is provided at one side of the second condenser 115, and a second evaporator fan 150*a* which is provided at one side of the second evaporator 150.

The second cycle of the refrigerator 10 further includes a second refrigerant pipe 102*a* which connects the second compressor 102, the second condenser 115, the second expansion device 135 and the second evaporator 150 and guides a flow of the refrigerant.

The refrigerator 10 further includes a first hot gas path 145 extended from an outlet side pipe of the first compressor 101 toward the second evaporator 150 side and coupled to the second evaporator 150. The first hot gas path 145 supplies a high temperature refrigerant compressed in the first compressor 101 to the second evaporator 150 to defrost the second evaporator 150.

A valve unit 140 may be installed at the outlet side pipe of the first compressor 101. The first hot gas path 145, which is connected to the valve unit 140, extends to the second evaporator 150, and may be configured to be connected to the first refrigerant pipe 101*a* via the second evaporator 150.

The first refrigerant pipe 101*a* includes a combination part 105 to which the first hot gas path 145 is connected. That is, one side edge of the first hot gas path 145 is connected to a second outlet part 143 of the valve unit 140, and the other side edge of the first hot gas path 145 may be connected to the combination part 105 of the first refrigerant pipe 101*a*.

The valve unit 140 includes a three-way valve having an inlet part 141 in which the refrigerant is introduced, and two outlet parts 142 and 143 from which the refrigerant is discharged. The inlet part 141 is connected to a valve inlet pipe 103 provided at an outlet side of the first compressor 101. The refrigerant compressed in the first compressor 101 may be introduced into the valve unit 140 via the valve inlet pipe 103 and the inlet part 141.

The two outlet parts 142 and 143 includes a first outlet part 142 which is configured to guide the refrigerant introduced into the valve unit 140 through the inlet part 141 to be discharged to a valve outlet pipe 104. That is, the first outlet part 142 may be connected to the valve outlet pipe 104. The valve outlet pipe 104 is extended from the first outlet part 142 to the first condenser 111.

The two outlet parts 142 and 143 further includes the second outlet part 143 which is configured to guide the refrigerant introduced into the valve unit 140 to be discharged to the first hot gas path 145. That is, the second outlet part 143 may be connected to the first hot gas path 145. In accordance with the operation mode of the refrigerator, a refrigerant introduced into the inlet part 141 of the valve unit 140 may be discharged to any one of the first outlet part 142 and the second outlet part 143.

Figure 5:
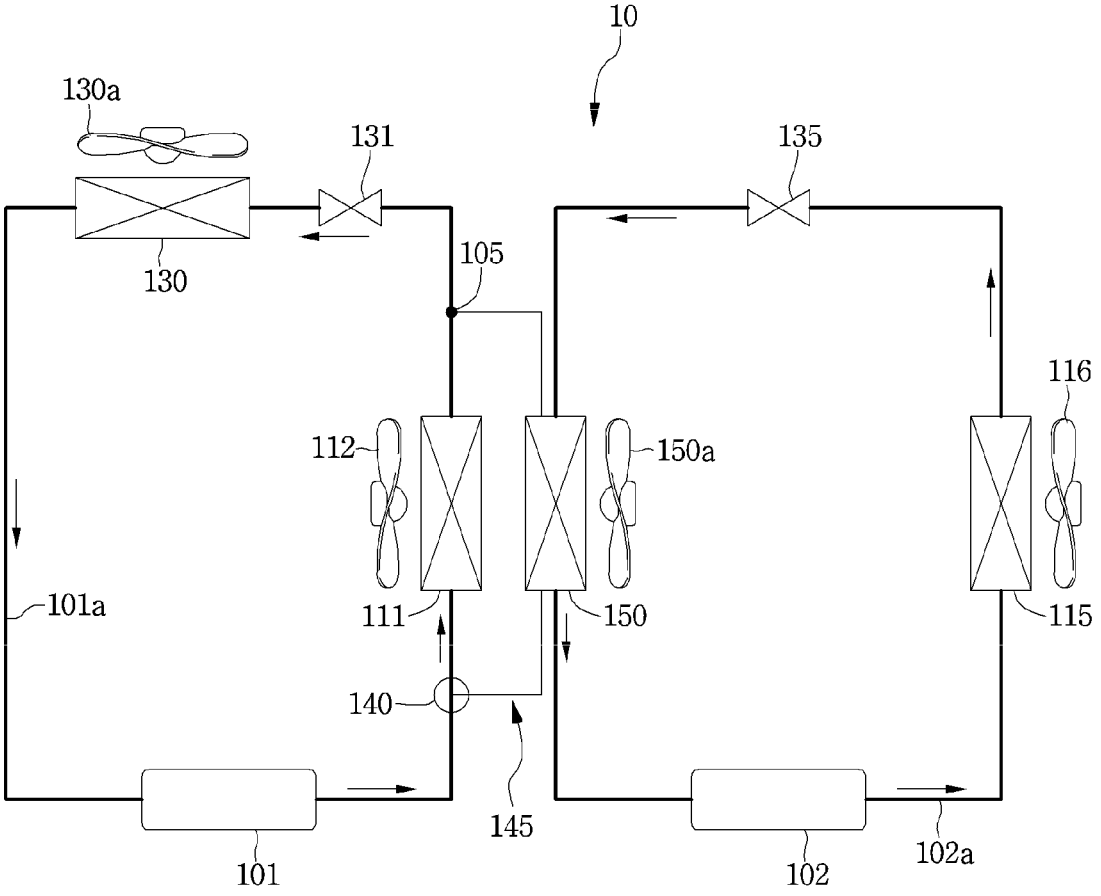
FIG. 5 illustrates a cycle of a flow of a refrigerant during a first mode operation of the refrigerator

Referring to FIG. 5, when the refrigerator 10 is operated in a normal mode, first operating mode, the valve unit 140 may be controlled in a predetermined operation mode. The normal mode may be understood as an operation mode which is performed without a defrosting operation of the first evaporator 130 or the second evaporator 150, and thus the refrigerator compartment 20 or the freezer compartment 30 is cooled.

For example, FIG. 5 illustrates a state in which a simultaneous cooling of the refrigerator compartment 20 and the freezer compartment 30 is performed by driving all of the first and second cycle of the refrigerator 10. When only a cooling of the refrigerator compartment 20 is required only a driving of the first compressor 101 may be performed. On the other hand, when only a cooling of the freezer compartment 30 is required only a driving of the second compressor 102 may be performed.

Hereinafter, a case in which the simultaneous cooling of the refrigerator compartment and the freezer compartment is performed is described as an example. In the normal mode operation of the refrigerator, the first cycle may be operated. Specifically, the first refrigerant compressed in the first compressor 101 is introduced into the inlet part 141 of the valve unit 140. The valve unit 140 may be controlled in the first operation mode. Specifically, the first outlet part 142 of the valve unit 140 is opened and the second outlet part 143 of the valve unit 140 is closed. Therefore, the first refrigerant introduced into the valve unit 140 through the inlet part 141 may be discharged to the first outlet part 142, and the flow of the first refrigerant through the first hot gas path 145 is restricted.

The first refrigerant discharged from the valve unit 140 is introduced into the first condenser 111 via the valve outlet pipe 104, depressurized in the first expansion device 131, and introduced into the first evaporator 130. The first refrigerant is evaporated in the first evaporator 130 and cool air generated in this process may be supplied to the refrigerator compartment 20. The first refrigerant passing through the first evaporator 130 may be suctioned into the first compressor 101 and compressed.

In the normal mode operation of the refrigerator 10, the second cycle may be operated. Specifically, the second refrigerant compressed in the second compressor 102 is condensed in the second condenser 115, depressurized in the second expansion device 135, and introduced into the second evaporator 150. The second refrigerant is evaporated in the second evaporator 150 and cool air generated in this process may be supplied to the freezer compartment 30. The second refrigerant passing through the first evaporator 130 may be suctioned into the second compressor 102 and compressed.

Figure 6:
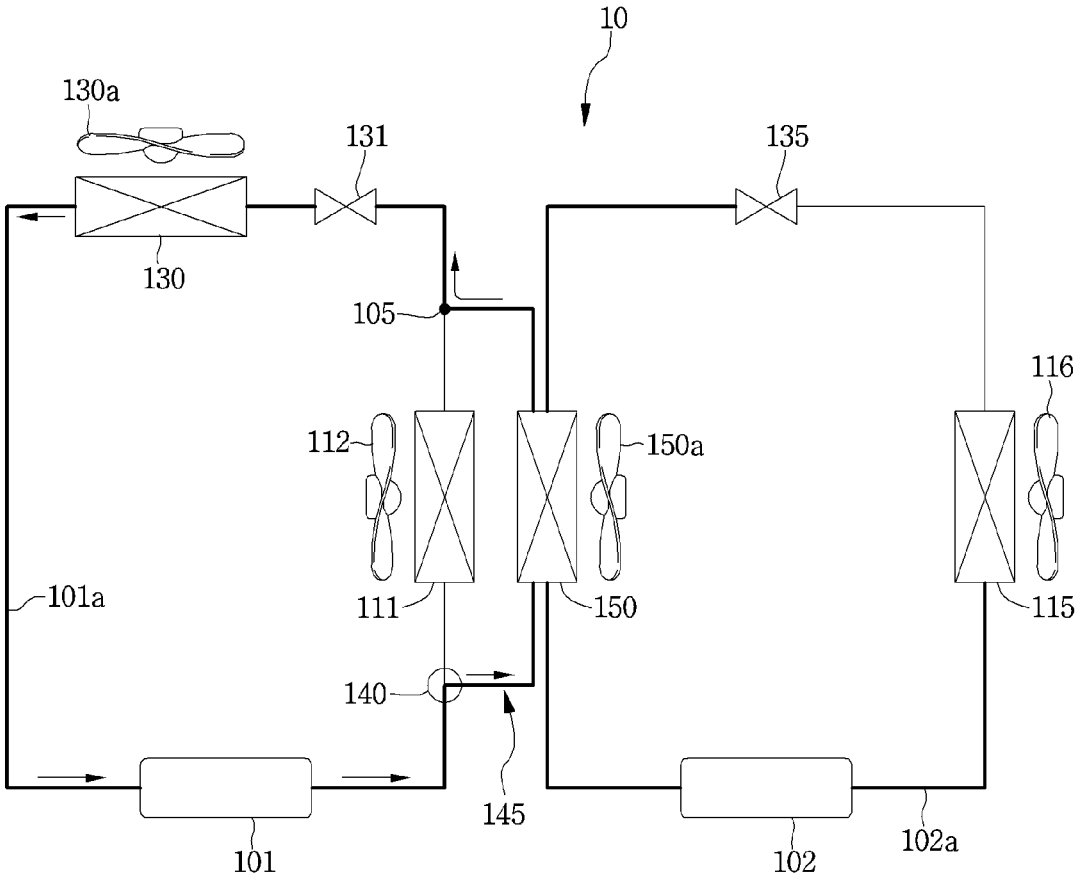
FIG. 6 illustrates a cycle of the flow of the refrigerant during a second mode operation of the refrigerator.

Referring to FIG. 6, when the refrigerator 10 is operated in a freezer compartment defrosting mode, that is a second operation mode, the valve unit 140 may be controlled in the second operation mode. Specifically, in the freezer compartment defrosting mode of the refrigerator 10, the first refrigerant compressed in the compressor 101 is introduced into the inlet part 141 of the valve unit 140. The first outlet part 142 of the valve unit 140 is closed, and the second outlet part 143 of the valve unit 140 is opened. Accordingly, the first refrigerant introduced into the valve unit 140 through the inlet part 141 and may be discharged through the second outlet part 143. The first refrigerant discharged from the valve unit 140 flows in the first hot gas path 145 and passes through the second evaporator 150.

In the process of the first refrigerant of the first hot gas path 145 passing through the second evaporator 150, the ice formed at the second evaporator 150 may be removed. The refrigerant passing through the second evaporator 150 is introduced into the first refrigerant pipe 101*a* through the first combination part 105, and depressurized in the first expansion device 131 and may flow into the first evaporator 130. At this time, by the closed first outlet part 142, the refrigerant may be restricted from flowing into the valve unit 140 from the first combination part 105.

The refrigerant is evaporated in the first evaporator 130 and cool air generated in this process may be supplied to the refrigerator compartment 20. The refrigerant passing through the first evaporator 130 is suctioned into the first compressor 101 and may be compressed. Meanwhile, in the process of defrosting the second evaporator 150, a circulation of the second refrigerant through the second cycle is stopped, that is, the second compressor 102 is not driven. According to such an action, in the process of defrosting the second evaporator 150, a cooling of the refrigerator compartment 20 may be performed through an operation of the first evaporator 130, and thus cooling performance of the refrigerator may be improved.

The defrosting of the first evaporator 130 may be performed through an operation of the first evaporator fan 130*a*. When the two cycles are performed, an evaporation temperature of the first evaporator 130 disposed at a high pressure side is formed relatively higher. For example, the evaporation temperature of the first evaporator 130 may be formed within a range of −5° C. to 0° C. Therefore, an ice forming amount of the first evaporator 130 may be small, and a frosting degree may not be serious.

Instead of using a separate high temperature refrigerant (hot gas), the cooling air in the refrigerator compartment 20 may be supplied to the first evaporator 130, and may perform the defrosting operation of the first evaporator 130 (natural defrosting). At this time, a driving of the first compressor 101 may be stopped. For an operation of the second cycle, the second compressor 102 is driven, a supplying of a cool air to the freezer compartment 30 may be performed.

According to such an action, the cooling operation of the freezer compartment 30 may be performed through the operation of the second cycle forming a separate cycle even when the defrosting operation of the first evaporator 130 is performed, and thus the cooling performance of the refrigerator may be prevented from being degraded. In comparison with the defrosting operation using the hot gas, the temperature of the first evaporator 130 may be kept relatively low through the natural defrosting operation, and thus when the first evaporator 130 is operated after the defrosting operation is terminated, evaporation performance may be improved.

Figure 11:
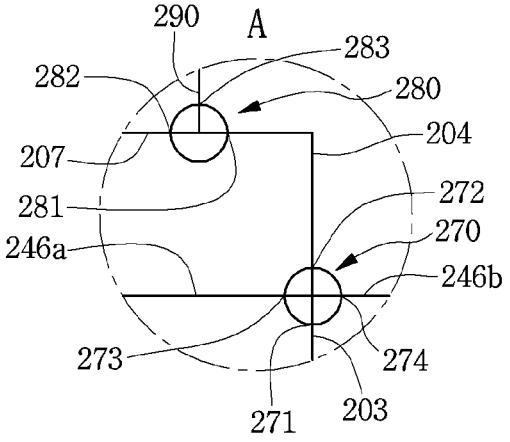
FIG. 11 is an enlarged view of a B portion of FIG. 10.

Referring to FIG. 11, the second evaporator 150 may include a plurality of refrigerant pipes 151 and 170 through which refrigerant having different phases from each other flows. The second evaporator may include a fin 155 which is coupled to the plurality of refrigerant pipes 151 and 170 and that is configured to increase a heat exchange area between the refrigerant and a fluid.

Specifically, the plurality of refrigerant pipes 151 and 170 includes a first pipe 151 through which the refrigerant depressurized in the second expander 104*a* flows, and a second pipe 170 through which the refrigerant condensed in the condenser 102 is supplied. The second pipe 170 forms at least a part of the first hot gas path 105, and may be referred to as a "hot gas pipe".

The second refrigerant flowing through the second pipe 170 may have a temperature higher than that of the refrigerant flowing through the first pipe 151.

The second evaporator 150 further includes coupling plates 160 and 165 which fix the first pipe 151 and the second pipe 170.

Specifically, a plurality of coupling plates 160 and 165 may be provided at both sides of the second evaporator 150. The coupling plates 160 and 165 include a first plate 160 which supports one side of each of the first pipe 151 and the second pipe 170, and a second plate 165 which supports the other side of each of the first pipe 151 and the second pipe 170. The first and second plates 160 and 165 may be disposed to be spaced apart from each other.

The first pipe 151 and the second pipe 170 may be formed to be bent in one direction from the first plate 160 toward the second plate 165 and the other direction from the second plate 165 toward the first plate 160.

The first and second plates 160 and 165 serve to fix both sides of the first pipe 151 and the second pipe 170, and are configured to prevent shaking of the first pipe 151 and the second pipe 170. For example, the first pipe 151 and the second pipe 170 may be disposed to pass through the first and second plates 160 and 165.

Each of the first and second plates 160 and 165 has a plate shape which extends longitudinally, and may have through-holes 166*a* and 166*b* through which at least parts of the first pipe 151 and 170 pass. Specifically, the through-holes 166*a* and 166*b* include a first through-hole 166*a* through which the first pipe 151 passes, and the second through-hole 166*b* through which the second pipe 170 passes.

The first pipe 151 may be disposed to pass through the first through-hole 166*a* of the first plate 160, to extend toward the second plate 165, and to pass through the first through-hole 166*a* of the second plate 165, and then a direction thereof may be changed so as to extend again toward the first plate 160.

The second pipe 170 may be disposed to pass through the second through-hole 166*b* of the first plate 160, to extend toward the second plate 165, and to pass through the second through-hole 166*b* of the second plate 165, and then a direction thereof may be changed so as to extend again toward the first plate 160.

The second evaporator 150 includes a first inlet part 151*a* which guides the introduction of the refrigerant into the first pipe 151, and a first outlet part 151*b* which guides the discharge of the refrigerant flowed through the first pipe 151. The first inlet part 151*a* and the first outlet part 151*b* form at least a part of the first pipe 151. For example, a two-phase refrigerant which is depressurized in the second expansion device 135 is introduced into the second evaporator 150 through the first inlet part 151*a*, evaporated during a heat exchange process, and then discharged from the second evaporator 150 through the first outlet part 151*b*.

The evaporator 150 includes a second inlet part 171 which guides the introduction of the refrigerant into the second pipe 170, and a second outlet part 172 which guides the discharge of the refrigerant flowed through the second pipe 170. The second inlet part 171 and the second outlet part 172 form at least a part of the second pipe 170.

For example, in the defrosting mode of the second evaporator 150, i.e., in the second operating mode, the high temperature first refrigerant compressed in the first compressor 101 flows in the first hot gas path 145 and is introduced into the second evaporator 150 through the first inlet part 171. The first refrigerant removes the ice generated at the second evaporator 150 during the heat exchange process at the second evaporator 150, and then discharged from the second evaporator 150 through the second outlet part 172.

A plurality of fins 155 are provided to be spaced apart from each other, and the first pipe 151 and the second pipe 170 are disposed to pass through the plurality of fins 155. Specifically, the fins 155 may be disposed to vertically and horizontally form a plurality of rows.

The coupling plates 160 and 165 include the hooks 162 and 167 which are coupled to the inner case 13. The hooks 162 and 167 are disposed at upper portions of the coupling plates 160 and 165, respectively. Specifically, the hooks 162 and 167 include a first hook 162 which is provided at the first plate 160, and a second hook 167 which is provided at the second plate 165.

The first and second support parts 163 and 168 through which the second pipe 170 passes are formed at the coupling plates 160 and 165, respectively. The first and second support parts 163 and 168 are disposed at lower portions of the coupling plates 160 and 165, respectively. Specifically, the first and second support parts 163 and 168 include a first support part 163 which is provided at the first plate 160, and a second support part 168 which is provided at the second plate 165.

The second pipe 170 includes an extension part 175 which forms a lower end of the evaporator 150. Specifically, the extension part 175 is formed to extend downward further than a lowermost fin 155 of the plurality of fins 155. The extension part 175 is located inside a water collection part 180 (referring to FIG. 11) which will be described later, and may supply heat to remaining frost in the water collection part 180. Defrosted water may be drained to a machinery compartment 50.

Due to the extension part 175, the second pipe 170 may have a shape which is inserted into the first and second support parts 163 and 168 and extends to a central portion of the evaporator 150. That is, due to a configuration in which the second pipe 170 passes and extends through the first and second support parts 163 and 168, the extension part 175 may be stably supported by the evaporator 150.

The first pipe 151 and the second pipe 170 may be installed to pass through the plurality of fins 155. The plurality of the fins 155 may be disposed to be spaced apart from each other at a predetermined distance. Specifically, each of the fins 155 includes a fin body 156 having an approximately quadrangular plate shape, and a plurality of through-holes 157 and 158 which are formed at the fin body 156 and through which the first pipe 151 and the second pipe 170 pass. The plurality of through-holes 157 and 158 includes a first through-hole 157 through which the first pipe 151 passes, and a second through-hole 158 through which the second pipe 170 passes. The plurality of through-holes 157 and 158 may be disposed in one row.

An inner diameter of the first through-hole 157 may have a size different from that of an inner diameter of the second through-hole 158. For example, the inner diameter of the first through-hole 157 may be formed larger than that of the second through-hole 158. In other words, an outer diameter of the first pipe 151 may be formed larger than that of the second pipe 170. This is because the first pipe 151 guides the flow of the refrigerant which performs an innate function of the evaporator 150, and thus a relatively large flow rate of the refrigerant is required. However, since the second pipe 170 guides the flow of the high temperature refrigerant for a predetermined time only when the defrosting operation of the evaporator 150 is required, a relatively small flow rate of the refrigerant is required.

Figure 9:
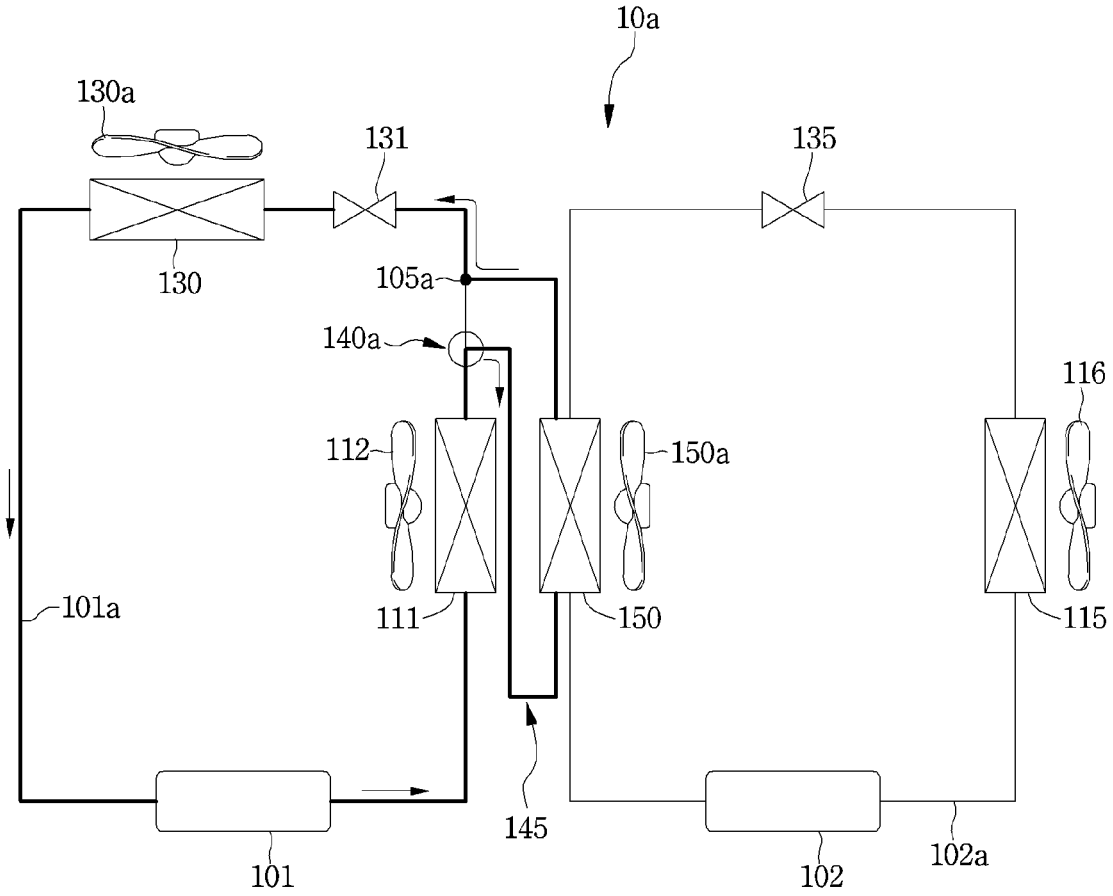
FIG. 9 illustrates an example of a cycle of a refrigerator.

Referring to FIG. 9, a refrigerator 10*a* may include a valve unit 140*a* installed on an outlet side pipe of the first condenser 111 and a first hot gas path 145*a* extended to the second evaporator 150 from the valve unit 140*a*. The first hot gas path 145*a* may be connected to a combination part 105*a* via the second evaporator 150. The combination part 105*a* may be located at a valve outlet pipe of the valve unit 140*a*. The valve outlet pipe may be extended to the first expansion device 131 from the valve unit 140*a*.

When a freezer compartment defrosting mode operation of the refrigerator 10*a*, the first refrigerant having passed through the first condenser 111 is introduced to the valve unit 140*a* and flows in the first hot gas path 145*a*. And the first refrigerant of the first hot gas path 145*a* flows to the second evaporator 150, removes the ice formed at the second evaporator 150 and may flow to the combination part 105*a*. The first refrigerant is introduced to the first evaporator 130 and evaporates, and cool air generated in this process may be supplied to the to the refrigerator compartment 20.

Figure 10:
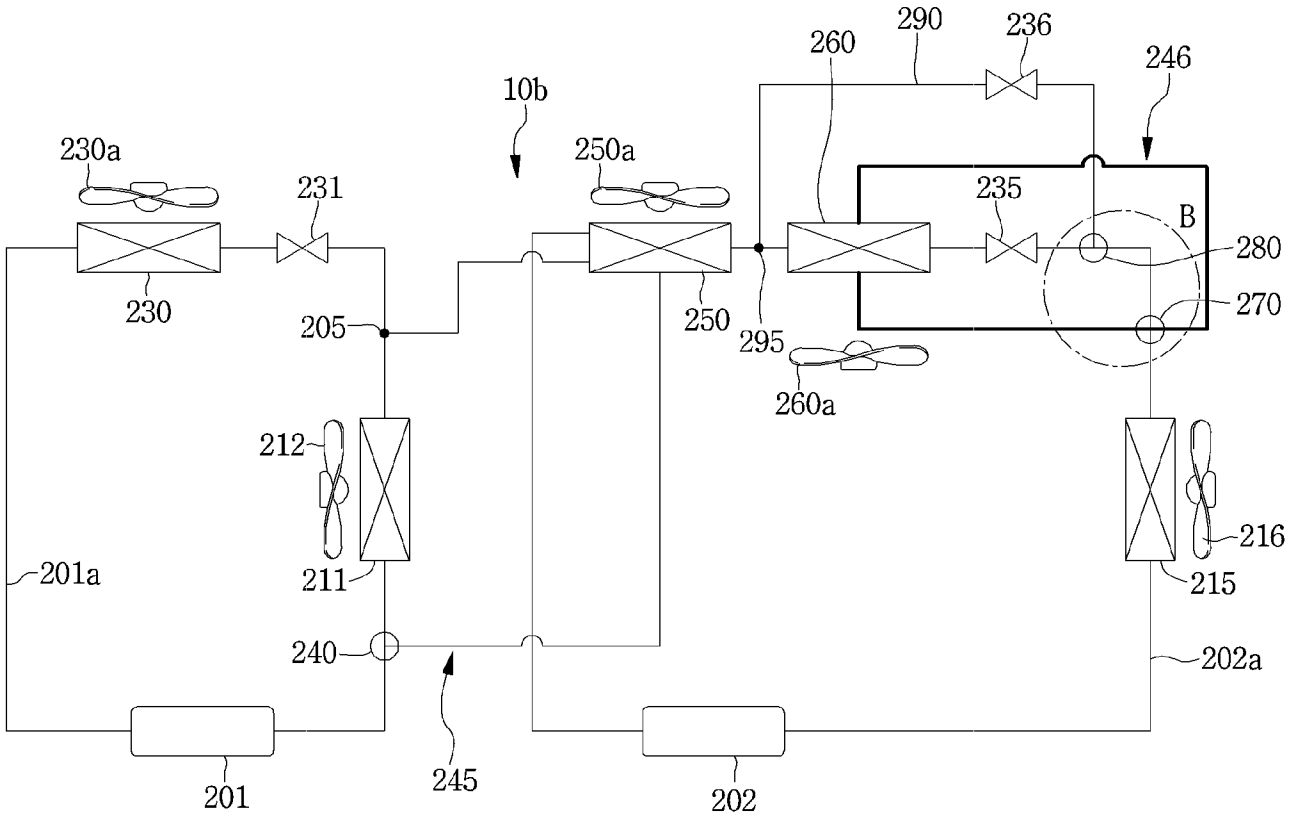
FIG. 10 illustrates an example of a cycle of a refrigerator.

Referring to FIGS. 10 and 11 a refrigerator 10*b* may include a plurality of devices for driving a refrigerating cycle. The refrigerating cycle includes a first cycle and a second cycle.

Specifically, the first cycle of the refrigerator 10*b* includes a first compressor 201 for compressing a refrigerant, a first condenser 211 condensing the refrigerant compressed in the first compressor 201, a first expansion device 231 for depressurizing the refrigerant condensed in the first condenser 211 and a first evaporator 230 for evaporating the refrigerant depressurized in the first expansion device 231. A refrigerant circulating in the first cycle may be named as a first refrigerant. The first evaporator 230 includes a refrigerator compartment evaporator for refrigerating the refrigerator compartment 20. The first expansion device 231 may include a capillary tube.

The first cycle of the refrigerator 10*b* further includes an air blowing fan provided on one side of the heat exchanger and blowing the air. The air blowing fan includes a first condensation fan 212 provided on one side of the first condenser 211 and a first evaporation fan 230*a* provided on one side of the first evaporator 230.

The first cycle of the refrigerator 10*b* further includes a first refrigerant pipe 201*a* connecting the first compressor 201, the first condenser 211, the first expansion device 231 and the first evaporator 230 and guiding the flow of the refrigerant.

The second cycle of the refrigerator 10*b* includes a second compressor 202 for compressing a refrigerant, a second condenser 215 condensing the refrigerant compressed in the second compressor 202, a plurality of expansion devices 235 and 236 for depressurizing the refrigerant condensed in the second condenser 215 and a plurality of evaporators 250 and 260 for evaporating the refrigerant depressurized in the plurality of expansion devices 235 and 236. A refrigerant circulating in the second cycle may be named as a second refrigerant and the second refrigerant is understood as a refrigerant immiscible with the first refrigerant.

The plurality of evaporators 250 and 260 includes a second evaporator 250 and a third evaporator 260 connected in series. The second evaporator 250 includes a freezer compartment evaporator for refrigerating the freezer compartment 30. The third evaporator 260 includes an evaporator for supplying the cool air to a switching chamber. The switching chamber may act as freezer compartment or fresh compartment. The fresh compartment may be maintained at a slightly lower temperature than the temperature of the refrigerator compartment, and may be used to store meat or fish. For example, the temperature of the refrigerator compartment is formed in a range of 0 to 5° C., and the temperature of the fresh compartment may be formed in a range of −1 to 2° C.

The plurality of expansion devices 235 and 236 includes a second expansion device 235 installed on an inlet side of the third evaporator 260 and a third expansion device 236 installed in a bypass path 290. The second expansion device 235 may be installed between a third valve unit 280 and the third evaporator 260. For example, the second and third expansion devices 235 and 236 may include a capillary tube.

The second cycle of the refrigerator 10*b* further includes an air blowing fan provided on one side of the heat exchanger and blowing the air. The air blowing fan includes a second condensation fan 216 provided on one side of the second condenser 215, a second evaporation fan 250*a* provided on one side of the second evaporator 250 and a third evaporation fan 260*a* provided on one side of the third evaporator 260.

The second cycle of the refrigerator 10*b* further includes a second refrigerant pipe 202*a* connecting the second compressor 202, the second condenser 215, the second and third expansion devices 235 and 236 and the second and third evaporators 250 and 260, and guiding the flow of the refrigerant.

The refrigerator 10*b* further includes a first hot gas path 245 extended from an outlet side pipe of the first compressor 201 toward the second evaporator 250. The hot gas path 245 supplies a high temperature refrigerant compressed in the first compressor 201 to the second evaporator 250, so that defrosting of the second evaporator 250 is made.

A first valve unit 240 is installed at the outlet side pipe of the first compressor 201. The first hot gas path 245 may be configured to be connected to the first valve unit 240, extended to the second evaporator 250, and connected to the first refrigerant pipe 201*a* via the second evaporator 250.

The first refrigerant pipe 201*a* includes a first combination part 205 to which the first hot gas path 245 is connected. That is, one end of the first hot gas path 245 is connected to a second outlet part of the first valve unit 240, and the other end may be connected to the first combination part 205 of the first refrigerant pipe 201*a*.

The first valve unit 240 includes a three-way valve having an inlet part in which the refrigerant is introduced and two outlet parts from which the refrigerant is discharged.

For defrosting of the third evaporator 260, the refrigerator 10*b* further includes a second hot gas path 246 supplying the refrigerant having passed through the second condenser 215 to the third evaporator 260.

The refrigerator 10*b* further includes a second valve unit 270 installed on an outlet side pipe of the second condenser 215. The second valve unit 270 includes a four-way valve. Specifically, the second valve unit 270 includes two inlet parts 271 and 274 and two outlet parts 272 and 273.

The two inlet parts 271 and 274 include a first inlet part 271 connected to a valve inlet pipe 203. The valve inlet pipe 203 is connected to an outlet side of the second condenser 215. Therefore, the refrigerant condensed in the second condenser 215 may be introduced into the second valve unit 270 through the first inlet part 271 via the valve inlet pipe 203.

The two inlet parts 271 and 274 include a second inlet part 274 connected to the second hot gas path 246. Specifically, the second hot gas path 246 includes an evaporator introduction pipe 246*a* extended from the second valve unit 270 to the third evaporator 260 and guiding introduction of the refrigerant toward the third evaporator 260, and an evaporator discharge pipe 246*b* extended from the third evaporator 260 to the second valve unit 270 and guiding the discharge of the refrigerant from the third evaporator 260.

The evaporator discharge pipe 246*b* is connected to the second inlet part 274. Therefore, the refrigerant supplied to the third evaporator 260 and performed a defrosting may be introduced into the second valve unit 270 through the second inlet part 274 via the evaporator discharge pipe 246*b*.

The two outlet parts 272 and 273 includes a first outlet part 272 connected to a valve outlet pipe 204. The valve outlet pipe 204 extends toward the third valve unit 280 from the first outlet part 272. Therefore, the refrigerant discharged from the second valve unit 270 through the first outlet part 272 may be introduced into the third valve unit 280 via the valve outlet pipe 204.

The two outlet parts 272 and 273 further include a second outlet part 273 connected to the evaporator introduction pipe 246*a*. Therefore, the refrigerant discharged from the second valve unit 270 through the second outlet part 273 may be introduced to the third evaporator 260 via the evaporator introduction pipe 246*a*.

The third valve unit 280 is installed at an outlet side of the second valve unit 270. The third valve unit 280 includes an inlet part 281 connected to the valve outlet pipe 204 and guiding the introduction of the refrigerant. Therefore, the refrigerant discharged through the first outlet part 272 of the second valve unit 270 may be introduced to the third valve unit 280 through the inlet part 281.

The third valve unit 280 further includes a first outlet part 282 guiding the refrigerant to the second expansion device 235. The first outlet part 282 is connected to a connection pipe 207. The connection pipe 207 is extended to the second expansion device 235 from the first outlet part 282 of the third valve unit 280. The second expansion device 235 is installed on the inlet side of the third evaporator 260 and may depressurize the refrigerant which will be introduced to the third evaporator 260.

The third valve unit 280 further includes a second outlet part 283 guiding the refrigerant to the bypass path 290. The bypass path 290 is connected to the second outlet part 283 and extended toward an inlet side of the second evaporator 250 and understood as a pipe which is bypassing the third evaporator 260.

In a preset operation mode of the refrigerator 10*b*, the refrigerant introduced into the third valve unit 280 may be introduced into the second evaporator 250 via the bypass path 290.

The second refrigerant pipe 202*a* includes a second combination part 295 with which the bypass path 290 is combined. The second combination part 295 may be located in a pipe connecting the second evaporator 250 and third evaporator 260. That is, one side part of the bypass path 290 may be connected to the third valve unit 280 and the other side part may be connected to the second combination part 295.

Figure 12:
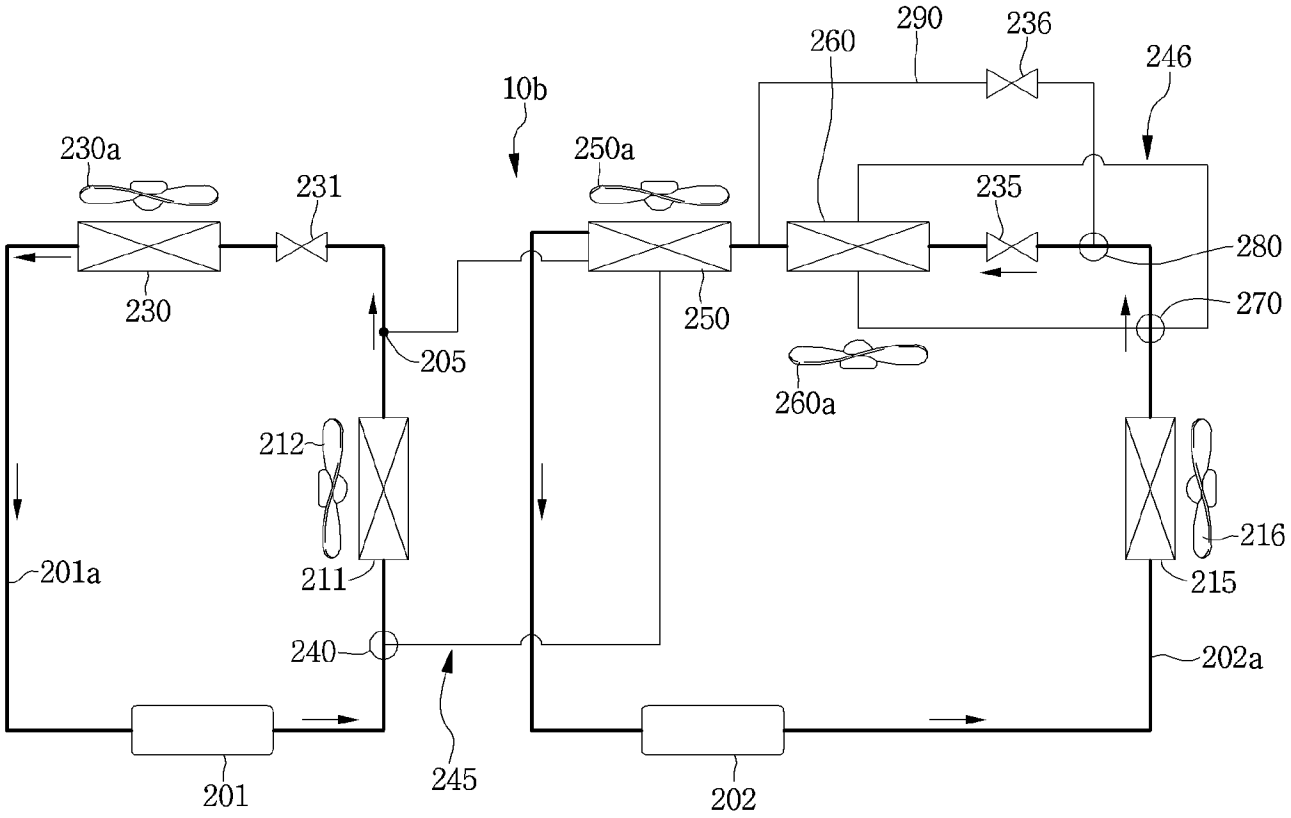
FIG. 12 illustrates an example of a state of a flow of a refrigerant during a first mode operation of the refrigerator.

First referring to FIG. 12, during a normal mode operation as a first operation mode of the refrigerator 10*b*, the first valve unit 240 may be controlled in a predetermined operating mode. The "normal mode" may be understood as an operation mode which makes the cooling of the refrigerator compartment 20, the freezer compartment 30 or the switching chamber without a defrosting operation of the first, second and third evaporators 230, 250 and 260.

During the normal mode operation of the refrigerator 10*b*, the first cycle may be operated. Specifically, the first refrigerant compressed in the first compressor 201 is introduced to the inlet part of the first valve unit 240. The first valve unit 240 may be controlled in a first operating mode.

Specifically, the first outlet part of the first valve unit 240 is opened and the second outlet part is closed. Therefore, the first refrigerant introduced to the first valve unit 240 through the inlet part may be discharged to the first outlet part. Then, the flow of the first refrigerant through the first hot gas path 245 is limited.

The first refrigerant discharged from the first valve unit 240 is introduced to the first condenser 211, depressurized in the first expansion device 231, and introduced into the first evaporator 230. The first refrigerant is evaporated in the first evaporator 230 and the cool air generated in this process may be supplied to the refrigerator compartment 20. The first refrigerant passed through the first evaporator 230 may be suctioned into the first compressor 201 and compressed.

During the normal mode operation of the refrigerator 10*b*, the second cycle may be operated. Specifically, the second refrigerant compressed in the second compressor 202 is condensed in the second condenser 215 and passing through the second valve unit 270 and the third valve unit 280 in order. That is, the second refrigerant introduced to the second valve unit 270 through the first inlet part 271 is discharged through the first outlet part 272 and introduced to the inlet part 281 of the third valve unit 280.

The second refrigerant introduced to the third valve unit 280 is depressurized while passing through the second expansion device 235 through the first outlet part 282. The refrigerant passing through the second expansion device 235 is introduced to the third evaporator 260 and evaporated, and then may be introduced to the second evaporator 250 and evaporated. The cool air generated in the third evaporator 260 is supplied to the switching chamber and the cool air generated in the second evaporator 250 may be supplied to the freezer compartment 30. The refrigerant passing through the second evaporator 250 may be suctioned to the second compressor 202 and compressed.

When the cooling operation is not required in the third evaporator 260, the refrigerant introduced to the third valve unit 280 is introduced to the bypass path 290 and may pass through the second evaporator 250 via the second combination part 295. Therefore, the cooling operation of the switching chamber is not performed and the cooing operation of the freezer compartment 30 may be performed.

Figure 13:
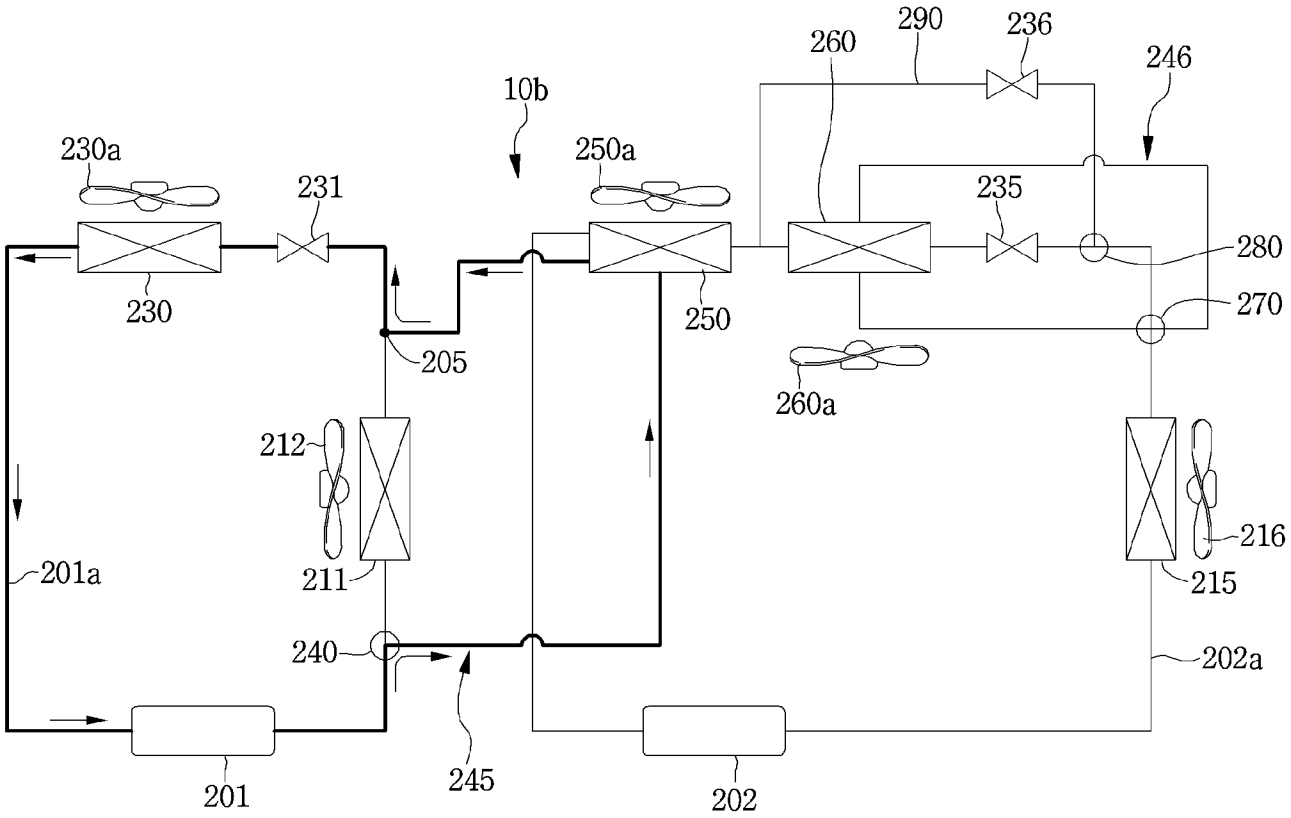
FIG. 13 illustrates an example of a state of the flow of the refrigerant during a second mode operation.

Second, referring to FIG. 13, when the freezer compartment defrosting mode operation as the second operation mode of the refrigerator, the first valve unit 240 may be operated in a second operating mode. Specifically, during the freezer compartment defrosting mode operation of the refrigerator, the first refrigerant compressed in the first compressor 201 is introduced to the inlet part of the first valve unit 240.

The first outlet part of the first valve unit 240 is closed and the second outlet part is opened. Therefore, the first refrigerant introduced to the first valve unit 240 through the inlet part may be discharged through the second outlet part. The refrigerant discharged from the first valve unit 240 flows in the hot gas path 245 and passes through the second evaporator 250.

In the process of the first refrigerant of the first hot gas path 245 passing through the second evaporator 250, the ice formed at the second evaporator 250 may be removed. The refrigerant passing through the second evaporator 250 is introduced into the first refrigerant pipe 201*a* through the first combination part 205, and depressurized in the first expansion device 231 and may flow into the first evaporator 230. At this time, by the closed first outlet part, the refrigerant may be restricted from flowing into the first valve unit 240 from the first combination part 205.

The refrigerant is evaporated in the first evaporator 230 and cool air generated in this process may be supplied to the refrigerator compartment 20. The refrigerant passing through the first evaporator 230 may be suctioned into the first compressor 201 and compressed.

Meanwhile, in the process of defrosting the second evaporator 250, a circulation of the second refrigerant through the second cycle is stopped, that is, the second compressor 202 is not driven. The defrosting of the first evaporator 230 may be accomplished by using the cool air stored in the refrigerator compartment 20 by driving the first evaporation fan 230*a* (natural defrosting).

Figure 14:
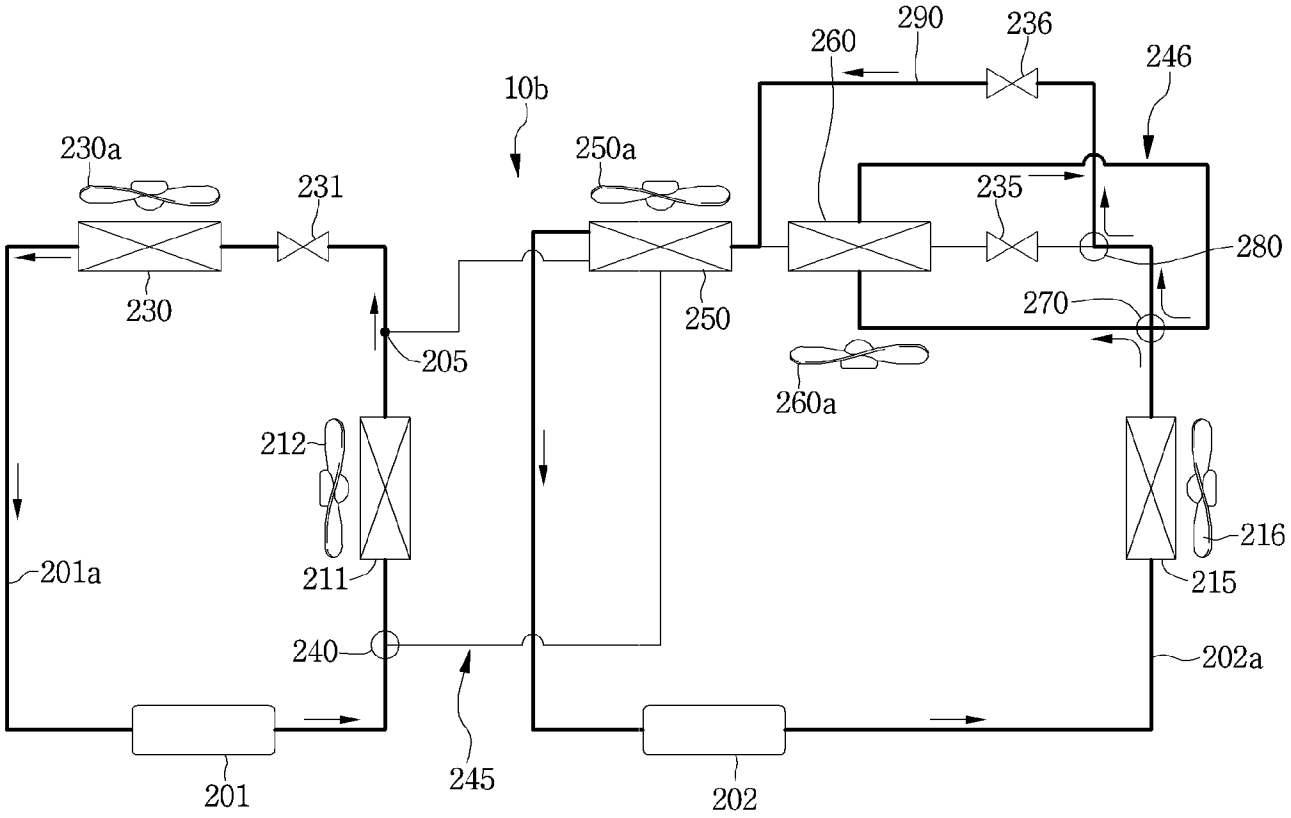
FIG. 14 illustrates an example of a state of the flow of the refrigerant during a third mode operation of the refrigerator.

Next referring to FIG. 14, in a switching chamber defrosting mode operation as a third operation mode of the refrigerator, the operation of the first cycle and the second cycle of the refrigerator 10*b* may be made. The operation of the first cycle is the same as FIG. 12, and thus detailed description will be omitted.

With respect to the operation of the second cycle, when the second compressor 202 is driven, the second refrigerant compressed in the second compressor 202 is condensed in the second condenser 215 and introduced into the second valve unit 270. The second valve unit 270 may be controlled so that the first inlet part 271 and the second outlet part 273 communicate and the second inlet part 274 and the first outlet part 272 communicate.

Therefore, the second refrigerant introduced to the second valve unit 270 through the first inlet part 271 is discharged through the second outlet part 273 and introduced to the second hot gas path 246. The second refrigerant is supplied to the third evaporator 260 via the second hot gas path 246 and performs defrosting of the third evaporator 260.

The second refrigerant passing through the third evaporator 260 is introduced to the second valve unit 270 through the second inlet part 274 and discharged from the second valve unit 270 through the first outlet part 272. The second refrigerant discharged from the second valve unit 270 is introduced to the inlet part 281 of the third valve unit 280. The third valve unit 280 may be controlled so that the first outlet part 282 is closed and the second outlet part 283 is opened.

The second refrigerant introduced to the third valve unit 280 flows to the bypass path 290 through the second outlet part 283. The second refrigerant flowing in the bypass path 290 is introduced to the second evaporator 250 via the second combination part 295. The second refrigerant evaporated in the second evaporator 250 may be suctioned into the second compressor 202 and compressed.

According to this action, by using the high temperature refrigerant condensed in the second condenser 215, the third evaporator 260 may be defrosted, and since the refrigerant expanded after defrosting may be evaporated in the second evaporator 250, the cooling of the freezer compartment 30 may be made.

Figure 15:
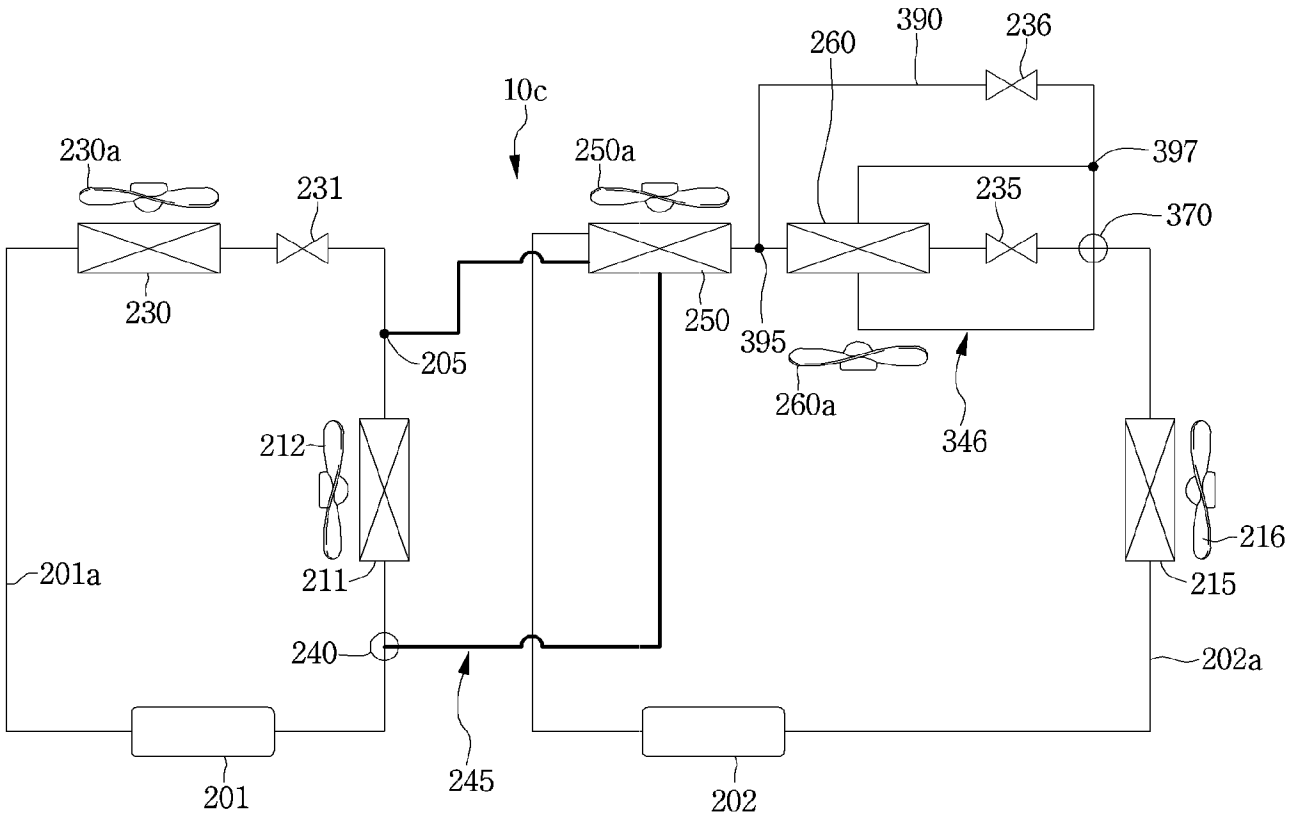
FIG. 15 illustrates an example of a cycle of a refrigerator.

Referring to FIG. 15 a refrigerator 10*c* may include a first cycle including a first compressor 201, a first condenser 211, a first expansion device 231 and a first evaporator 230. The refrigerator 10*c* is provided with a second cycle including a second compressor 202, a second condenser 215, second and third expansion devices 235 and 236, and second and third evaporators 250 and 260. The second cycle of the refrigerator 10*c* further includes a second valve unit 370 installed on an outlet side pipe of the second condenser 215. For example, the second valve unit 370 includes a four-way valve.

The second cycle further includes a second hot gas path 346 extended to the third evaporator 260 from the second valve unit 370 for defrosting the third evaporator 260. The second hot gas path 346 is connected to a bypass path 390 via the third evaporator 260.

The bypass path 390 includes a third combination part 397 to which the second hot gas path 346 is connected. That is, the second hot gas path 346 is extended to the bypass path 390 from the third evaporator 260 and connected to the third combination part 397.

The second valve unit 370 includes one inlet part and three outlet parts. The one inlet part includes a first inlet part connected to the outlet side pipe of the second condenser 215. The three outlet parts include a first outlet part connected to an inlet side pipe of the second expansion device 235, a second outlet part to which the hot gas path 346 is connected and a third outlet part to which the bypass path 390 is connected.

The refrigerant introduced into the second hot gas path 346 through the second outlet part is supplied to the third evaporator 260 and may defrost the third evaporator 260. The refrigerant having passed through the third evaporator 260 is introduced to the bypass path 390 through the third combination part 397 and may flow to into the second evaporator 250.

One side of the bypass path 390 is connected to the third outlet part of the second valve unit 370, and the other side may be connected to a pipe connecting the second evaporator 250 and the third evaporator 260. That is, the other side of the bypass path 390 may be connected to a second combination part 395 provided in the second refrigerant pipe 202*a*.

Figure 16:
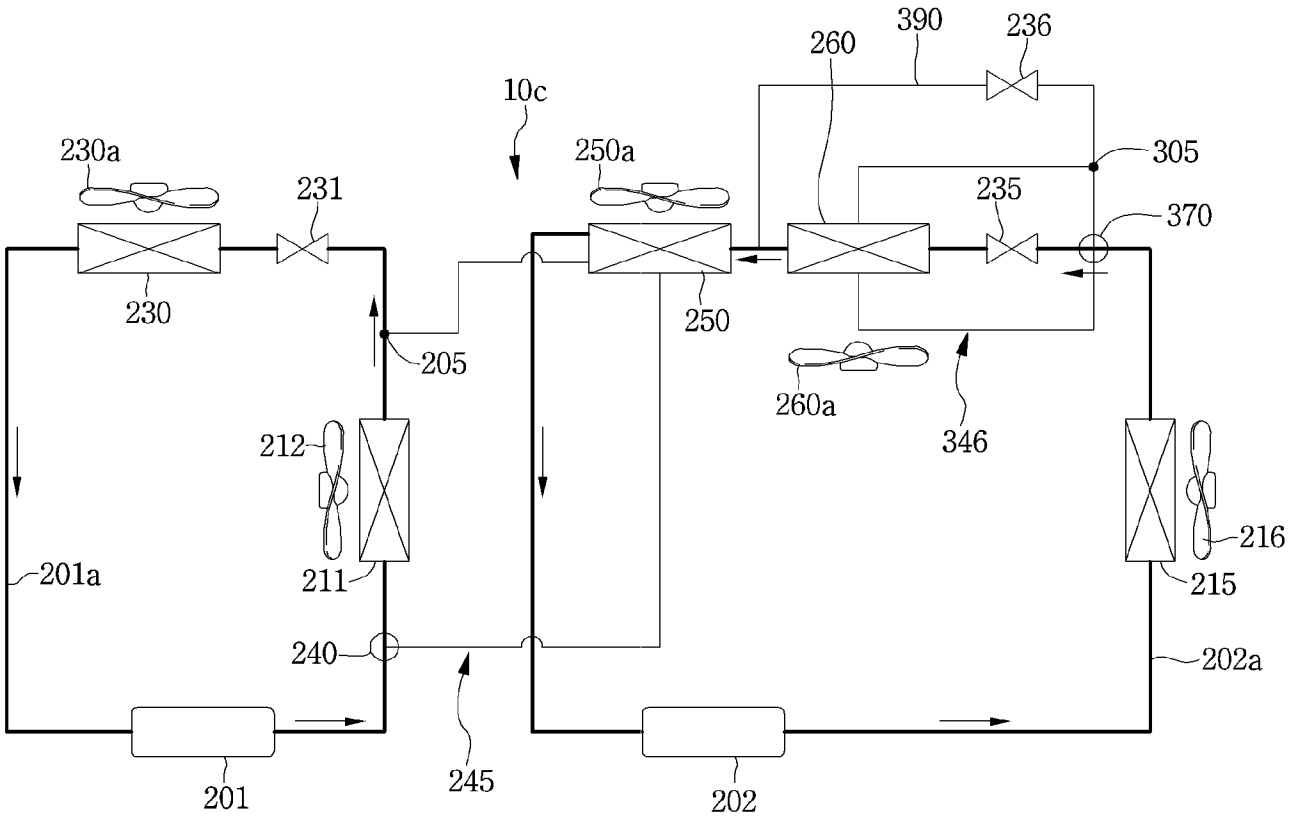
FIG. 16 illustrating an example of a state of a flow of a refrigerant during a first mode operation of the refrigerator

First referring to FIG. 16, during a normal mode operation as a first operation mode of the refrigerator 10*c*, a first refrigerant of the first cycle circulates the first compressor 201, the first condenser 211, the first expansion device 231 and the first evaporator 230 and performs the cooling operation of the refrigerator compartment 20.

Figure 17:
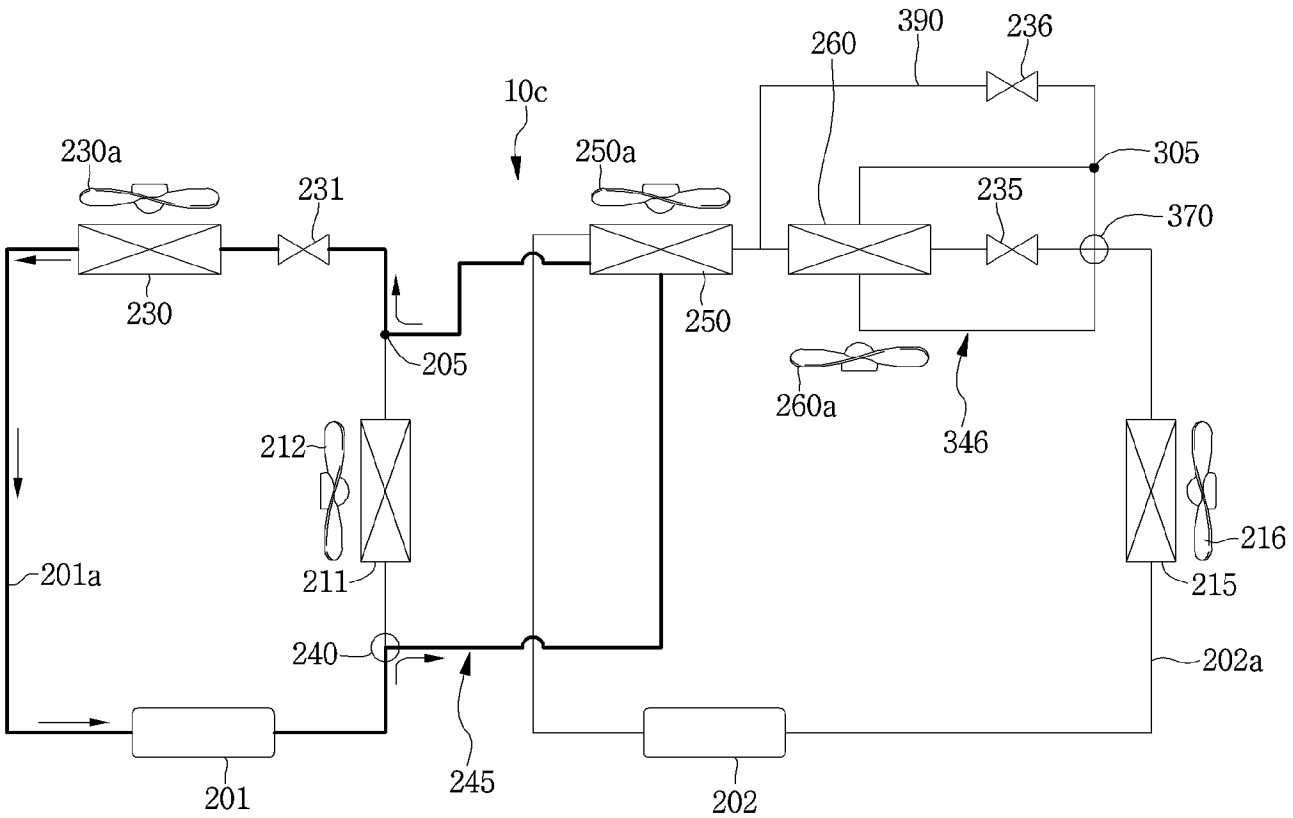
FIG. 17 illustrates an example of a state of the flow of the refrigerant during a second mode operation of the refrigerator.

In case of the second cycle, a second refrigerant circulates the second compressor 202, the second condenser 215, the second valve unit 370, the third evaporator 260 and the second evaporator 250, and performs the cooling operation of the freezer compartment 30 and the switching chamber. The second refrigerant introduced to the second valve unit 370 may be introduced to the second evaporator 250 via the bypass path 390 if the cooling operation of the switching chamber is not required. Accordingly, through the operation of the second cycle, the cooling operation of the freezer compartment 30 may be performed Referring to FIG. 17, when the freezer compartment defrosting mode operation as the second operation mode of the refrigerator 10*c* is performed, the operation of the second cycle is stopped. That is, the driving of the second compressor 202 may be stopped.

In case of the first cycle, when the first compressor 201 is driven, the first refrigerant compressed in the first compressor 201 is introduced into the first hot gas path 245 through the first valve unit 240. The first refrigerant is supplied to the second evaporator 250 and performs the defrosting operation of the second evaporator 250 and flows into the first expansion device 231 through the first combination part 205. The first refrigerant depressurized in the first expansion device 231 is evaporated at the first evaporator 230 and cool air generated in the first evaporator 230 may be supplied to the refrigerator compartment 20. According to this action, the defrosting operation of the second evaporator 250 and the cooling operation of the first evaporator 230 may be made together.

The defrosting operation of the first evaporator 230 may be performed in a natural defrosting method for supplying cool air stored in the refrigerator compartment 20 to the first evaporator 230.

Figure 18:
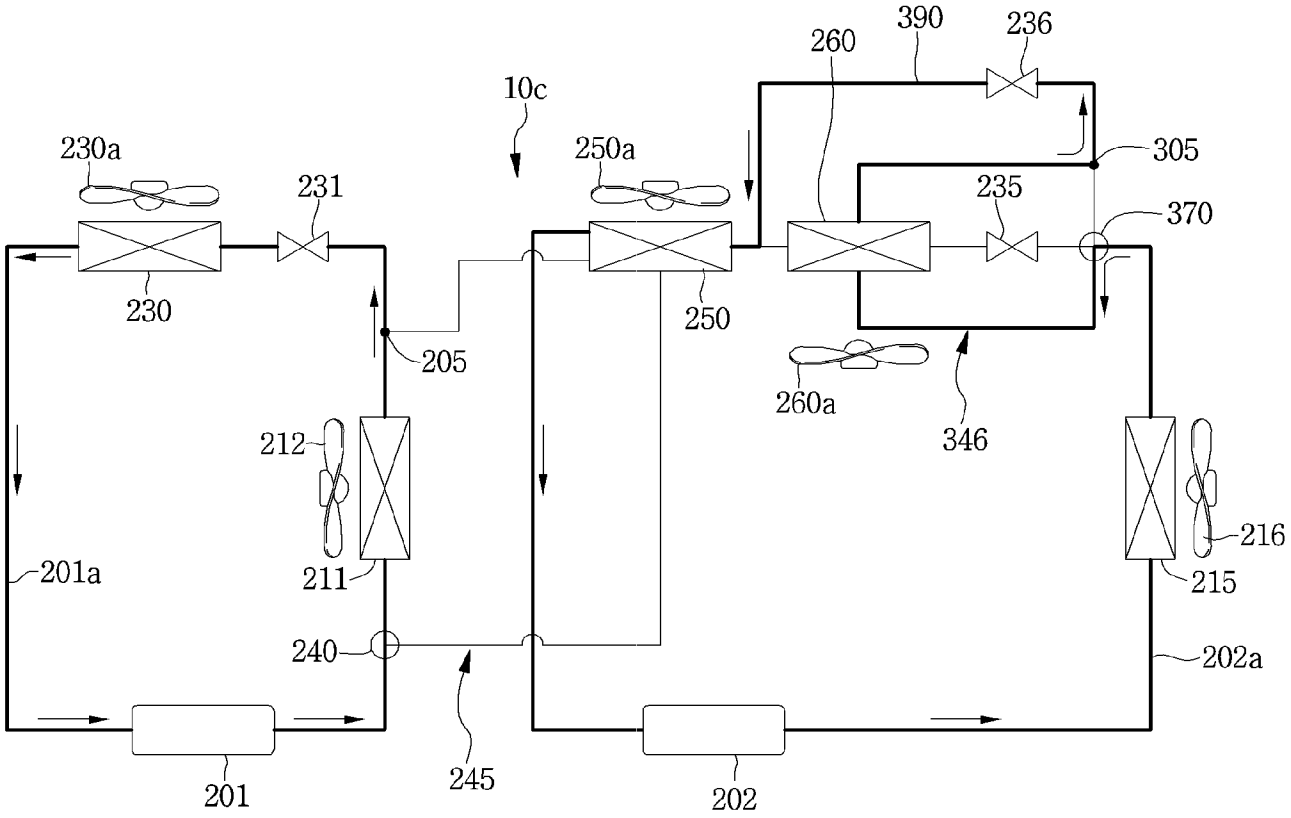
FIG. 18 illustrates an example of a state of the flow of the refrigerant during a third operation of the refrigerator.

Referring to FIG. 18, when a switching chamber defrosting mode operation as a third operation mode of the refrigerator 10*c* is performed, the refrigerant of the first cycle circulates the first compressor 201, the first condenser 211, the first expansion device 231 and the first evaporator 230 and performs the cooling operation of the refrigerator compartment 20.

With respect to the operation of the second cycle, the second refrigerant compressed in the second compressor 202 is condensed while passing the second condenser 215 and introduced to the second valve unit 370. The second refrigerant introduced to the second valve unit 370 flows toward the second hot gas path 346 and is supplied to the third evaporator 260. The second refrigerant defrosts the third evaporator 260 while passing through the third evaporator 260 and introduced to the bypass path 390 via the third combination part 397.

The second refrigerant of the bypass path 390 may be introduced to the second evaporator 250 via the second combination part 395. The refrigerant evaporated in the second evaporator 250 may be suctioned into the second compressor 202 and compressed.

Figure 19:
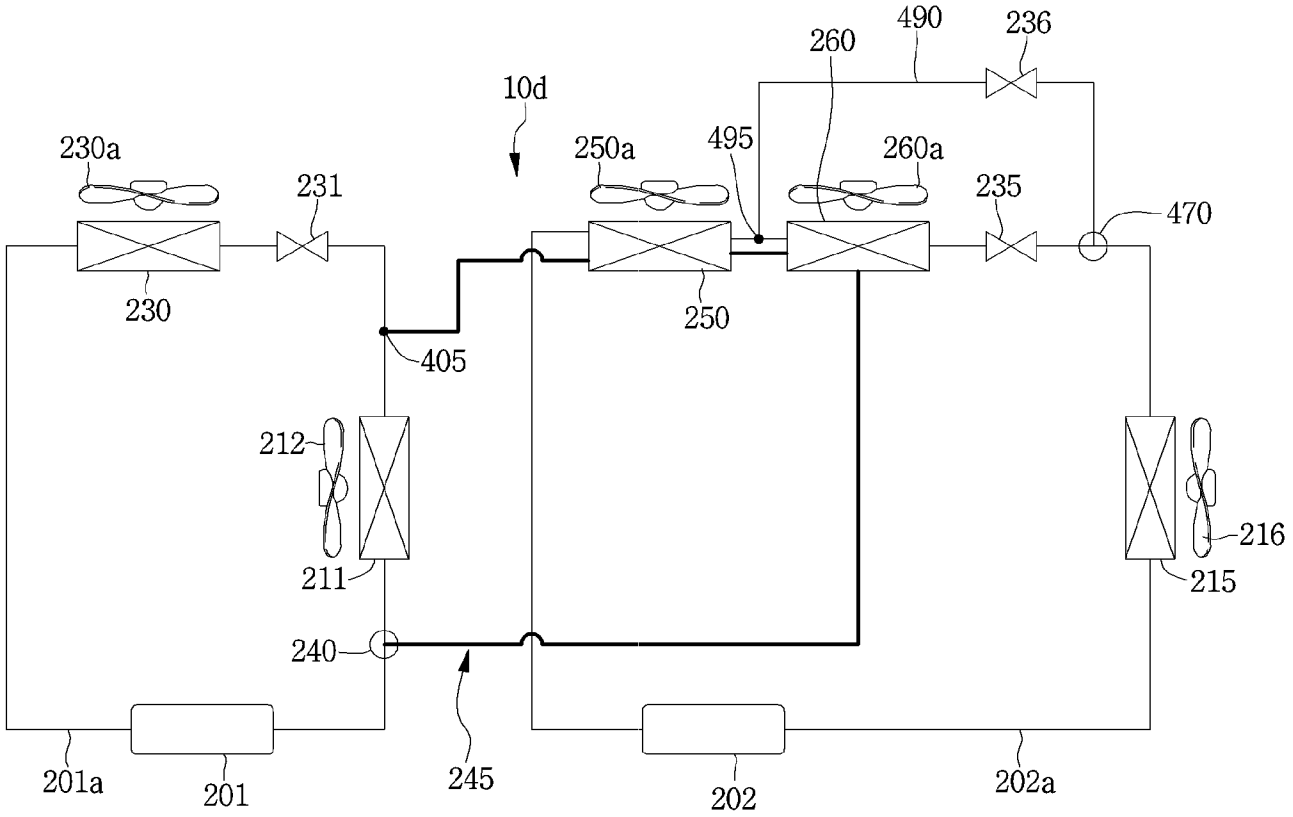
FIG. 19 illustrates an example of a cycle of a refrigerator.

Referring to FIG. 19 a refrigerator 10*d* may include a first cycle in which a first refrigerant is circulating and a second cycle in which a second refrigerant is circulating. The first cycle includes a first compressor 201, a first condenser 211, a first expansion device 231 and a first evaporator 230. The second cycle includes a second compressor 202, a second condenser 215, second and third expansion devices 235 and 236, and second and third evaporators 250 and 260.

The refrigerator 10*d* further includes a first valve unit 240 installed on an outlet side pipe of the first compressor 201 and a first hot gas path 445 connected to the first valve unit 240 and extended toward the second evaporator 250 and the third evaporator 260.

One side part of the first hot gas path 445 is connected to the first valve unit 240 and the other side part is connected to a first combination part 405. The first combination part 405 is formed at one point of a first refrigerant pipe 201*a* located at an outlet side of the first condenser 211. Specifically, the first hot gas path 445 may extend from the first valve unit 240 to the third evaporator 260 to be coupled thereto, may extend from the third evaporator 260 to the second evaporator 250, and may extend from the second evaporator 250 to the first combination part 405.

The first hot gas path 445 is coupled to the second and third evaporators 250 and 260. The second cycle further includes a second valve unit 470 installed on an outlet side pipe of the second condenser 215 and a bypass path 490 extended from the second valve unit 470 and connected to an outlet side pipe of the third evaporator 260. A second combination part 495 to which the bypass path 490 is connected is provided at the outlet side pipe of the third evaporator 260. The second expansion device 235 is located between the second valve unit 470 and the third evaporator 260, and the third expansion device 236 is installed in the bypass path 490.

Figure 20:
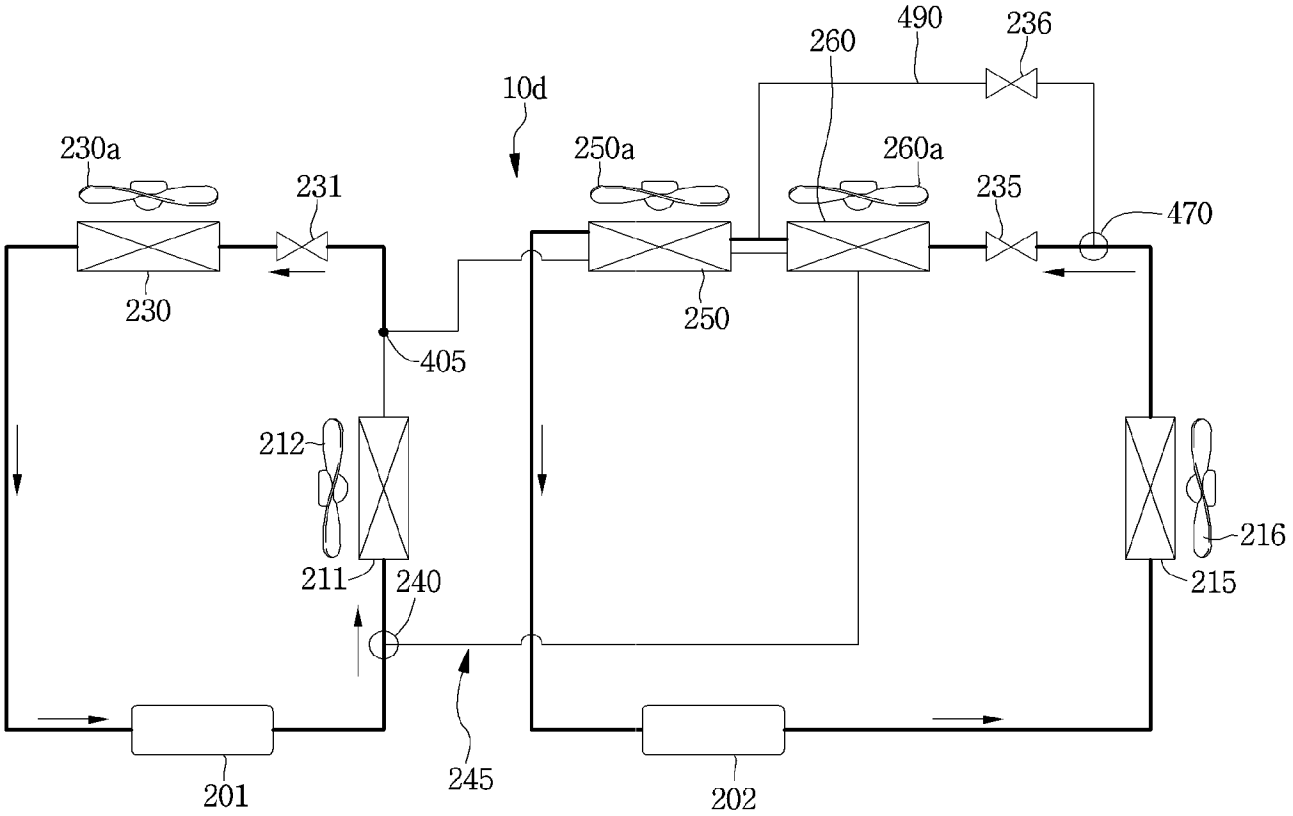
FIG. 20 is a cycle view illustrating a state of a flow of a refrigerant during a first operation of the refrigerator

Referring to FIG. 20, during a normal mode operation as a first operation mode of the refrigerator 10*d*, the first refrigerant of the first cycle circulates the first compressor 201, the first condenser 211, the first expansion device 231 and the first evaporator 230 and performs the cooling operation of the refrigerator compartment 20.

In case of the second cycle, the second refrigerant circulates the second compressor 202, the second condenser 215, the second valve unit 470, the third evaporator 260 and the second evaporator 250, and performs the cooling operation of the freezer compartment 30 and the switching chamber The second refrigerant introduced into the second valve unit 470 may be introduced to the second evaporator 250 via the bypass path 490 if the cooling operation of the switching chamber is not required. Therefore, the cooling operation of the freezer compartment 30 may be performed through the operation of the second cycle.

Figure 21:
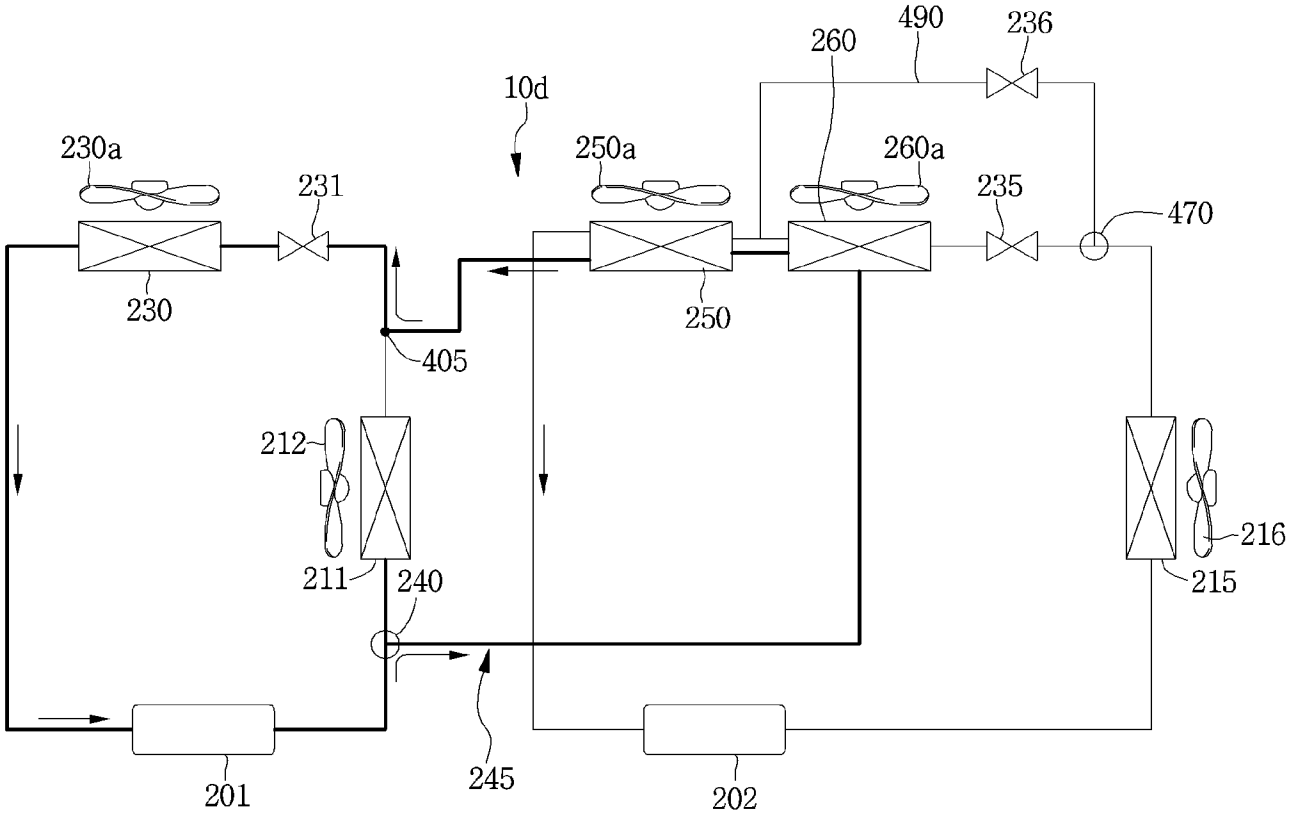
FIG. 21 is a cycle view illustrating a state of the flow of the refrigerant during a second operation of the refrigerator.

Referring to FIG. 21, when the defrosting mode operation of the freezer compartment and the switching chamber as a second operation mode of the refrigerator 10*d* is performed, the operation of the second cycle is stopped. That is, the driving of the second compressor 202 may be stopped.

In case of the first cycle, when the first compressor 201 is driven, the first refrigerant compressed in the first compressor 201 is introduced to the first hot gas path 445 through the first valve unit 240. The first refrigerant is first supplied to the third evaporator 260 and then performs defrosting of the third evaporator 260 while flowing in the first hot gas path 445.

The first refrigerant having passed through the third evaporator 260 is supplied to the second evaporator 250 and performs defrosting of the second evaporator 250. The first refrigerant having passed through the second evaporator 250 passes through the first expansion device 231 via the first combination part 405.

The first refrigerant depressurized in the first expansion device 231 is evaporated in the first evaporator 230 and the cool air generated in the first evaporator 230 is supplied to the refrigerator compartment 20. The refrigerant evaporated in the first evaporator 230 may be suctioned to the first compressor 201 and compressed. According to this action, in the process in which the cooling operation of the refrigerator compartment 20 is performed, since the defrosting operation of the second and third evaporators 250 and 260 may be performed together, the cooling performance and the defrosting performance may be improved.

Meanwhile, since the evaporation temperature of the first evaporator 230 is relatively high, the cool air of the refrigerator compartment 20 may be supplied to the first evaporator 230 by driving the first evaporation fan 230*a*. In this process, the defrosting of the first evaporator 230 may be performed (natural defrosting operation).

The defrosting of the evaporator can be performed using the high temperature refrigerant (or the hot gas), and may not require the installation of a conventional defrosting heater thereby reducing operation costs.

The refrigerant of the first cycle passed through the compressor or the condenser may flow to the evaporator of the second cycle, perform the defrosting operation, be condensed while the defrosting operation is performed, and then can be evaporated in the evaporator of the first cycle, and thus the storage compartment in which the evaporator of the first cycle is installed can be cooled.

The condensation temperature of the refrigerant may be lowered during the flowing of the refrigerant in the evaporator of the second cycle, and also cooling efficiency in the evaporator of the first cycle can be improved by evaporating in the evaporator of the first cycle after condensation.

The evaporator may include the first pipe through which the refrigerant to be evaporated flows, the second pipe through which the high temperature refrigerant flows, and the fin which is coupled to the first and second pipes, and thus in the defrosting operation, the ice formed on the evaporator can be removed using the high temperature refrigerant, and thus defrosting efficiency can be improved.

The heat of the high temperature refrigerant may be transferred to the evaporator in a heat conduction method, and the defrosting efficiency may be improved, the defrosting time may be shortened, and a temperature of the storage compartment may be prevented from being excessively increased during the defrosting operation.

What is claimed is:

1. A refrigerator comprising:

a first refrigeration cycle unit that is configured to circulate a first refrigerant, and that includes a first compressor, a first condenser, a first capillary tube, and a first evaporator;

a second refrigeration cycle unit that is configured to circulate a second refrigerant, and that includes a second compressor, a second condenser, a second capillary tube, a second evaporator, and a third evaporator including (i) a first pipe in which the second refrigerant decompressed in the second capillary tube is introduced and (ii) a second pipe;

a first valve unit installed at an outlet side of the first compressor;

a first hot gas path that extends from the first valve unit to the second evaporator, and that is configured to supply the first refrigerant to the second evaporator;

a second valve unit installed at an outlet side of the second condenser, wherein the second valve includes:

an inlet connected to an outlet pipe of the second condenser and into which the second refrigerant passing through the second condenser is introduced, a first outlet that is configured to supply the second refrigerant to the first pipe of the third evaporator, and a second outlet that is configured to supply the second refrigerant to the second pipe of the third evaporator; and a second hot gas path that extends from the second outlet of the second valve unit to the second pipe of the third evaporator, and that is configured to supply the second refrigerant condensed in the second condenser to the third evaporator.

2. The refrigerator according to claim 1, further comprising:

a bypass path that extends from the second valve unit to an outlet side of the third evaporator, wherein the second hot gas path extends from the second pipe of the third evaporator and is configured to connect to a combination part of the bypass path.

3. The refrigerator according to claim 2, wherein the second valve unit includes a four-way valve that includes the inlet and three outlets including the first outlet and the second outlet.

4. The refrigerator according to claim 3, wherein the three outlets further comprise a third outlet that is configured to connect to the bypass path, wherein the first outlet is configured to connect to an inlet pipe of the second capillary tube.

5. The refrigerator according to claim 4, wherein a first side of the bypass path is configured to connect the third outlet of the second valve unit, and wherein a second side of the bypass path is configured to connect to a connection pipe that is connected to the second and the third evaporators.

6. The refrigerator according to claim 5, wherein the second evaporator is serially connected to the third evaporator by the connection pipe.

7. The refrigerator according to claim 4, wherein the second hot gas path comprises:

a first portion that is configured to connect the second outlet of the four-way valve to a first side of the second pipe of the third evaporator; and a second portion that is configured to connect the bypass path to a second side of the second pipe of the third evaporator.

8. The refrigerator according to claim 2, further comprising a third capillary tube installed at the bypass path.

9. The refrigerator according to claim 1, wherein the first evaporator and the third evaporator are each a refrigerating compartment evaporator, and the second evaporator is a freezing compartment evaporator.

10. The refrigerator according to claim 1, wherein the first valve unit is a three-way valve.

11. The refrigerator according to claim 1, wherein a first side of the first hot gas path is configured to connect to the first valve unit, and wherein a second side of the first hot gas path is connected to a pipe that is configured to connect the first condenser and the first capillary tube.

12. The refrigerator according to claim 1, further comprising a first evaporation fan that is installed on one side of the first evaporator, and that is configured to defrost the first evaporator.

13. The refrigerator according to claim 1, wherein the third evaporator further comprises a fin in which the first and second pipes are coupled.

* * * * *